United States Patent [19]

Sugden et al.

[11] Patent Number: 4,646,853

[45] Date of Patent: Mar. 3, 1987

[54] SHAFT BORING MACHINE AND METHOD

[75] Inventors: David B. Sugden, Tasmania, Australia; David T. Cass, Seattle; Peter B. Dowden, Kirkland, both of Wash.; Nicholas A. Hynd, Tempe, Ariz.

[73] Assignee: The Robbins Company, Kent, Wash.

[21] Appl. No.: 636,381

[22] Filed: Jul. 31, 1984

[51] Int. Cl.[4] ..... E21D 1/06

[52] U.S. Cl. ..... 175/94; 175/57; 175/99; 175/102

[58] Field of Search ..... 175/94, 95, 97, 98, 175/99, 102, 104, 57, 92, 161, 244; 299/18, 31, 29, 39, 64, 77

[56] References Cited

U.S. PATENT DOCUMENTS

| | | | |
|---|---|---|---|
| 902,517 | 10/1908 | Wittich | 175/102 |
| 2,221,226 | 11/1940 | Wick . | |
| 2,587,844 | 3/1952 | Harrison . | |
| 2,769,614 | 11/1956 | Zeni . | |
| 3,770,067 | 11/1973 | Ikeda . | |
| 3,894,587 | 7/1975 | Sourice . | |
| 3,965,995 | 6/1976 | Sugden | 175/99 X |
| 3,995,907 | 12/1976 | DuBois . | |
| 4,102,415 | 7/1978 | Cunningham . | |
| 4,141,414 | 2/1979 | Johansson | 175/99 X |
| 4,274,675 | 6/1981 | Paurat et al. . | |
| 4,494,617 | 1/1985 | Snyder | 299/31 X |
| 4,548,442 | 10/1985 | Sugden et al. . | |

FOREIGN PATENT DOCUMENTS

| | | | |
|---|---|---|---|
| 251896 | 6/1961 | Australia | 175/161 |
| 815251 | 6/1959 | United Kingdom | 175/161 |
| 2111561A | 7/1981 | United Kingdom . | |

OTHER PUBLICATIONS

Blind Shaft Boring Machine Project Phase I, Final Report (Jul. 1976), pp. 6-1 to 6-20.

Blind Shaft Boring Machine Project, Final Report (Sep. 1981), pp. 1-1 to 1-35.

Stack, B., Handbook of Mining and Tunneling Machinery, Chichester John Wiley & Sons, 1982, pp. 125-130, 136-137.

*Primary Examiner*—Stephen J. Novosad
*Assistant Examiner*—Thomas J. Odar
*Attorney, Agent, or Firm*—Graybeal & Cullom

[57] ABSTRACT

A shaft boring machine including a rotatable cutterwheel assembly with a horizontal axis mounted on a carriage having vertical travel. The carriage is mounted on a slewing base frame and rotates about the vertical axis of the machine. An excavating unit for muck removal is mounted opposite the cutterwheel on the slewing base frame and loads directly from the shaft bottom into a muck hopper. When the hopper is full, it is discharged into a hoist bucket which is hoisted to the surface. The machine is positioned in the shaft by upper and lower gripper systems. Walking cylinders between the two gripper rings advance the machine up or down the shaft.

A method of boring vertical shafts in medium and hard rock which includes the steps of: (a) providing, radially of the shaft, a cutterwheel assembly for cutting the rock; (b) while rotating the cutterwheel assembly about its horizontal axis, plunging the rotating cutterwheel downwardly into the rock; (c) slewing the rotating cutterwheel assembly around the rock work face and about the central vertical axis of the shaft; and, (d) removing the rock cuttings from the work face.

36 Claims, 14 Drawing Figures

A - A

B - B

C - C

D - D

SHAFT BORING MACHINE AND METHOD

BACKGROUND OF THE INVENTION (1) Field of the Invention

The present invention relates to earth boring machines and methods for boring large diameter vertical blind shafts through medium and hard rock formations. A typical use of the present shaft boring machine is to construct a vertical mine shaft. The invention fills a long-felt need and brings the advantages of machine rock boring to blind shaft construction. These advantages are basically: higher advance rates; an accurate, smooth bore which facilitates shaft equipping and significantly cuts concreting costs; reduced manpower; and, safer working conditions. The higher advance rates of the present shaft boring machine in the sinking of the shaft can be accomplished because the machine can operate on a continuous basis rather than in cycles as in the conventional drill-and-blast method of blind shaft sinking. It is intended that the machine will be used in conjunction with appropriate auxiliary service stages and hoisting systems to allow the installation of primary and secondary lining, ventilation, and other required services as the machine advances. Such auxiliary equipment is not included in the scope of the invention.

(2) Description of the Prior Art

The prior art includes the following machines:

Wick U.S. Pat. No. 2,221,226 discloses in FIG. 1 a large diameter shaft sinking and excavating machine having a non-rotary cylindrical caisson 3 extending upwardly from a shoe blade 4. The rotary frame 8 supported in the lower end of the caisson rotates about the vertical centerline and has shovels 19 which push the earth toward the center of the machine. The rotary frame 8 also carries plows 20 as shown in FIG. 5 which dig up the earth. Conveyor 30 lifts the earth vertically in scoops 41 and at the upper sprocket 34 the earth is thrown into the swingable spout 53 which directs the earth into a first bucket 49 as shown in FIG. 2. When the first bucket is full, it is lifted by a hoisting unit located at the surface. Raising the full bucket 49 tips the spout 53 towards the empty bucket. The buckets 49 travel in channeled tracks 42.

Harrison U.S. Pat. No. 2,587,844 discloses a cage and operating mechanism for a shaft shovel 111. A hoist 100 is connected to the cable 106 which passes over the pulley 99 on the hinged pulley boom 98 and extends downwardly to operate the shovel 111. A second hoist 103 is mounted on the plate 104. The second hoist 103 is connected to the crowding mechanism of the dipper stick 109 by the cable 107. The hoist 103 actuates the dipper stick 109 while the hoist 100 raises and lowers the shovel 111 which in turn is secured to the end of the dipper stick 109. The dipper stick 109 may be either advanced or retarded with respect to the swinging boom 97 by means of the hoist 103. The tub 114 has a cable 115 connected thereto which extends up to the top of the shaft so that the tub 114 may be raised or lowered by suitable surface equipment. A cord 116 is connected to the latch 117 on the back of the shovel 111 and the cord 116 extends upward to the operator's cage. In operation, the operator commences the excavation by retarding or advancing the position of the dipper stick and at the same time raising the shovel so as to break up rock and aggregate. The shovel 111 is moved to a position directly above the tub 114 and then the shovel is tripped by means of the cord 116 which is connected to the latch 119. The tub may then be raised to the surface to permit disposal of the rock and aggregate and then the operation is repeated until the excavation of the vertical shaft has been completed.

Zeni U.S. Pat. No. 2,769,614 discloses in FIG. 6 a shaft sinking machine including a circular plate 10 providing an operating head with a cylindrical casing 11 extended downwardly from its peripheral edge and having toothed rotary cutters 12 journaled on the lower edge thereof, a motor platform 13 which is stationary and which is provided with a peripheral flange 14 from which the head 10 is suspended with spaced clips 15 which are U-shaped in cross section, a pump platform 16 spaced above the motor platform 13 by struts 18, a horizontally disposed screen 19 positioned above the disk 17, an anti-torque vise including threaded studs 20 mounted in sleeves 21 and actuated by nuts 22 to adjust the machine in relation to the shaft, hydraulic cylinders 23 mounted on the motor platform 13 and pivotally connected to toggle acting levers 24, a plurality of motors 25, a vacuum pump 26 and a hydraulic pump 27. In operation, compressed air is forced downwardly from a conventional compressor or from the pressure side of the vacuum pump 26 through a tube 43 to a head 44 from which the air is distributed by ducts 45 to nozzles 46 which are adjacent to the toothed rotary cutters 12. The cuttings from the cutters and drags 6 positioned between the cutters are drawn upwardly by the vacuum from the pump 26 through ducts 47 which extend upwardly through the partition 41 and into the open area 42 where the cuttings, as indicated by the numeral 48, are deposited upon the upper surface of the partition 41. The ducts 47 are provided with collecting nozzles as indicated by the numeral 49. From the open area 42, the air is drawn through the tube 72 to the suction side of the vacuum pump 26.

Ikeda U.S. Pat. No. 3,770,067 discloses in FIG. 2 a reaction counterbalanced earth boring machine 1 intended to be used underwater. The machine 1 has a body 100 including a central member 110, a transmission gear box 130 secured to the central member 110, and submersible electric motors 120 mounted on the gear box 130. The central member 110 is a double pipe construction including an inner pipe 111 and an outer pipe 112 which are connected with the water exhaust hose 5 and the water supply hose 4. The water supplied under pressure through the water supply hose 4 is passed between the inner pipe 111 and the outer pipe 112 and discharged from nozzles 141. The inner pipe 111 is connected at an intermediate point to the air supply hose 6 which supplies compressed air for exhausting slime through the water exhaust hose 5. The pressurized water is discharged to the bottom of the hole which is being bored by cutters 160. The water carries the slime produced during the boring operation up through the inner pipe 111 for discharge from the hole. Thus, the machine maintains a reverse water circulation. As shown in FIG. 3, each of the cutters 160 is rotated clockwise about its own axis as shown by the arrow P while revolving about the axis of the machine in the counterclockwise direction as shown by the arrow Q. Thus, the rotating torque acting on the cutters is counterbalanced by the revolving torque.

Sourice U.S. Pat. No. 3,894,587 discloses a machine for drilling in hard rock formations comprising a frame 1 which is in the form of a box section furnished at its upper end with rings 2 which enable it to be suspended from suspension members 3. The frame 1 is also furnished with guide plates 4 having angled edges which cooperate with the walls of the hole 5 which the machine is excavating. At the lower face of the frame 1, there are plate-like supports 6 which carry a hydraulic or electric motor 7 having a variable speed. The motors rotate in opposite directions in order to cancel out the resulting reaction forces. The shafts 9 of the motors 7 carry drums 11 which extend from the support 6 to the plane of the guide plate 4. Each of the drums 11 is fitted with peripheral helical threads 12 carrying tools 13, such as teeth or small rollers. The helical threads 12 are symmetrically arranged relative to the support 6 and are of opposing pitch so that when the drums revolve in the direction shown in FIG. 1, the excavated materials are brought towards the center of the device so that they can be removed through a central duct 14 mounted on frame 1. In operation, mud is poured into the excavation for the purpose of filling the excavation and preventing the walls from falling in. The mud is continuously removed by the duct 14 together with the excavated material by inverse circulation.

Sugden U.S. Pat. No. 3,965,995, assigned to The Robbins Company, discloses a machine 10 for boring a large diameter blind hole consisting of a cutter wheel 60 mounted at the lower end of the machine for rotation about a horizontal tubular support 58. The cuttings are picked up by buckets 74 on the cutter wheel 60 and are directed into the tubular support 58 to be received by an endless bucket conveyor 78 which carries them upwardly to a discharge station. As the machine is advanced, the cutter wheel 60 is rotated to make a first cut in the shape of the leading portion of the cutter wheel. The cutter wheel is then retracted from the cut and is rotated about the axis of the hole. This positions the cutter wheel so that when it is advanced again it will make a second cut which crosses the first. This procedure is repeated until the desired cross-sectional configuration of the hole is obtained. The cuttings of earth material are raised upwardly and are discharged into first one and then the other of the lift buckets 32 and 34. In FIG. 1, bucket 32 is shown receiving cuttings and the bucket 34 is shown in an elevated position with the cuttings from it being discharged into the hopper 52. A similar hopper 54 is provided for bucket 32 on the opposite side of the tower 30. Hoppers 52 and 54 serve to accumulate the cuttings and periodically discharge them into a truck or other transporting means provided for carrying them away from the work site.

Dubois U.S. Pat. No. 3,995,907 discloses an underground excavating machine having independently movable half-frames The machine includes two half-frames vertically arranged side-by-side, with two parallel vertical shafts supported by the two half-frames. A separate turret is pivotally supported around each of the shafts, each turret having a cutting head which can rotate about a horizontal axis and which is equipped with tools for excavating. The two half-frames are slidably movable horizontally in relation to one another, with a control member connected between the two half-frames for controlling the relative movement, the two half-frames being selectively positionable on the gallery floor by the relative movement, one half-frame being movable while the other half-frame remains fixed in position.

Cunningham U.S. Pat. No. 4,102,415 discloses an earth drilling machine including a main body tube with jacks to releasably support it within a drilled shaft or within an erected startup shaft. An outer casing is rotatably mounted within the main body tube, and carries a horizontal base on which are driven wheels and vertical shafts which have cutting elements. Means within the casing for fluid input and evacuation within the drill area is provided to form a slurry of the fluid and the excavated material for withdrawal through the casing. As the drilling continues, the main body tube is lowered into the shaft. The cutting elements include plates with cutting edges mounted on individual axles so that the edges are maintained in cutting relation to the area to be drilled.

Paurat et al U.S. Pat. No. 4,274,675 discloses a shaft-sinking apparatus with a milling head and a central worm conveyor. The machine platform can be anchored against the wall of the shaft and carries an orbiting tool for cutting away the floor of the shaft, thereby dumping the cuttings into a pilot-bore hole continuously drilled by a pilot-bore unit. The pilot-bore unit has a head for advancing the pilot bore and is provided with a worm conveyor running centrally through the shaft to transfer the cuttings to a bucket on a loading platform disposed above the main platforms. The platforms have cylinder arrangements whereby they are independently anchored to the vertical wall of the shaft.

Paurat et al U.K. Patent Application GB No. 2,111,561A discloses a machine for sinking mine shafts consisting of a cross beam 1 adapted to be disposed in a shaft SW, a cutter attached thereto for excavating the shaft floor SO, a vertical conveyor 3, and a transfer attachment 4 to transfer the excavated material to the vertical conveyor. The cutter has a milling and conveying worm 2 to swivel about the shaft axis 5 and feed the excavated material to the axis of the shaft. The cross beam 1 is equipped with bracing shoes 6 which can be extended or retracted to fix the position of the cross beam. The milling and conveying worm 2 and the cross beam 1 are movable relative one to the other by means of a cylinder-piston unit 8 disposed between the cross beam 1 and the conveying worm 2. The vertical conveyor 3 is formed by a belt conveyor which is deflected from the vertical into the horizontal and is formed into a tubular conveyor 9 in the vertical run and a trough 10 in the horizontal run where it functions as the input section of the transfer attachment. The machine is used in an operating cycle whereby the milling and conveying worm 2 and the cross beam 1 move relative one to the other with rhythmic forward and backward movements, thereby excavating the shaft floor SO.

SUMMARY OF THE INVENTION

One embodiment of the invention is a shaft boring machine for cutting a vertical shaft in medium and hard rock. The machine includes a cutterwheel assembly having a substantially horizontal axis of rotation and having multiple peripherally mounted rolling cutter units. Motors are provided for rotating the cutterwheel assembly about its horizontal axis. A cutterwheel carriage and vertical guide columns support the cutterwheel assembly and allow movement of the cutterwheel assembly in a vertical plane. A base frame supports the vertical guide columns. The base frame is slewed in a substantially horizontal plane by a slew drive system. Plunge cylinders mounted on the cutterwheel carriage and the base frame lower and raise the cutterwheel assembly in a vertical plane. A muck removal unit for removing rock cuttings from the face of the shaft is also supported by the base frame. A lower gripper ring stabilizes the machine in the shaft and includes a circular track for supporting the base frame and further includes a lower gripper cylinder system for holding the gripper ring stationary in the shaft. The base frame includes support rollers for rotatably supporting the base frame from the lower gripper ring. An upper gripper ring provides further stabilization of the machine in the shaft and includes an upper gripper cylinder system for holding the upper gripper ring stationary in the shaft. Walking cylinders are mounted on the lower and upper gripper rings for raising and lowering the rings.

Another embodiment of the invention is a method of boring a large diameter, blind hole vertical shaft by arranging a rolling cutter carrying cutterwheel radially of the shaft for rotation in a vertical plane and then rotating the cutterwheel about a horizontal axis while slewing the cutterwheel about the center axis of the shaft and across the bore work face. The cutterwheel is of a bevelled cross-sectional configuration, with a slightly increasing diameter in the trailing portion thereof. Cut material is removed from the bore work face by a clam shell bucket following the rotating cutterwheel.

Another embodiment of the invention is a method of boring vertical shafts in medium and hard rock using the following steps. First, providing a cutterwheel assembly for cutting the rock, the cutterwheel assembly having a substantially horizontal axis of rotation and having multiple peripherally mounted rolling cutter units, each rotatable about its own axis. Second, while rotating the cutterwheel assembly about its substantially horizonta axis, plunging the rotating cutterwheel assembly downwardly a selected depth into the rock work face. Third, while rotating the cutterwheel assembly about its substantially horizontal axis, slewing the rotating cutterwheel assembly about a vertical axis around or across the rock work face, the rolling cutter units on the cutterwheel assembly being rotatated about their respective axes by contact with the work face in the course of slewing around the work face. Fourth, removing the rock cuttings from the work face while slewing the cutterwheel assembly around the work face. Fifth, stopping the slewing movement of the cutterwheel assembly at a point which is 360° from the starting point. And sixth, repeating the last four steps.

Another embodiment of the invention is a method of boring vertical shafts in medium and hard rock using the following steps. First, providing a cutterwheel assembly for cutting the rock, the cutterwheel assembly having a substantially horizontal axis of rotation and having multiple peripherally mounted rolling cutter units each rotatable about its own axis. Second, while rotating the cutterwheel assembly about its substantially horizontal axis, progressively plunging the rotating cutterwheel assembly downwardly into the rock work face. Third, while rotating the cutterwheel assembly about its substantially horizontal axis, slewing the rotating cutterhead assembly about a vertical axis around or across the rock work face, the rolling cutter units on the cutterwheel assembly being rotated about their respective axes by contact with the work face in the course of slewing around the work face. And fourth, removing the rock cuttings from the work face while slewing the cutterwheel assembly around the work face.

DESCRIPTION OF THE PREFERRED EMBODIMENTS

Figure 1:
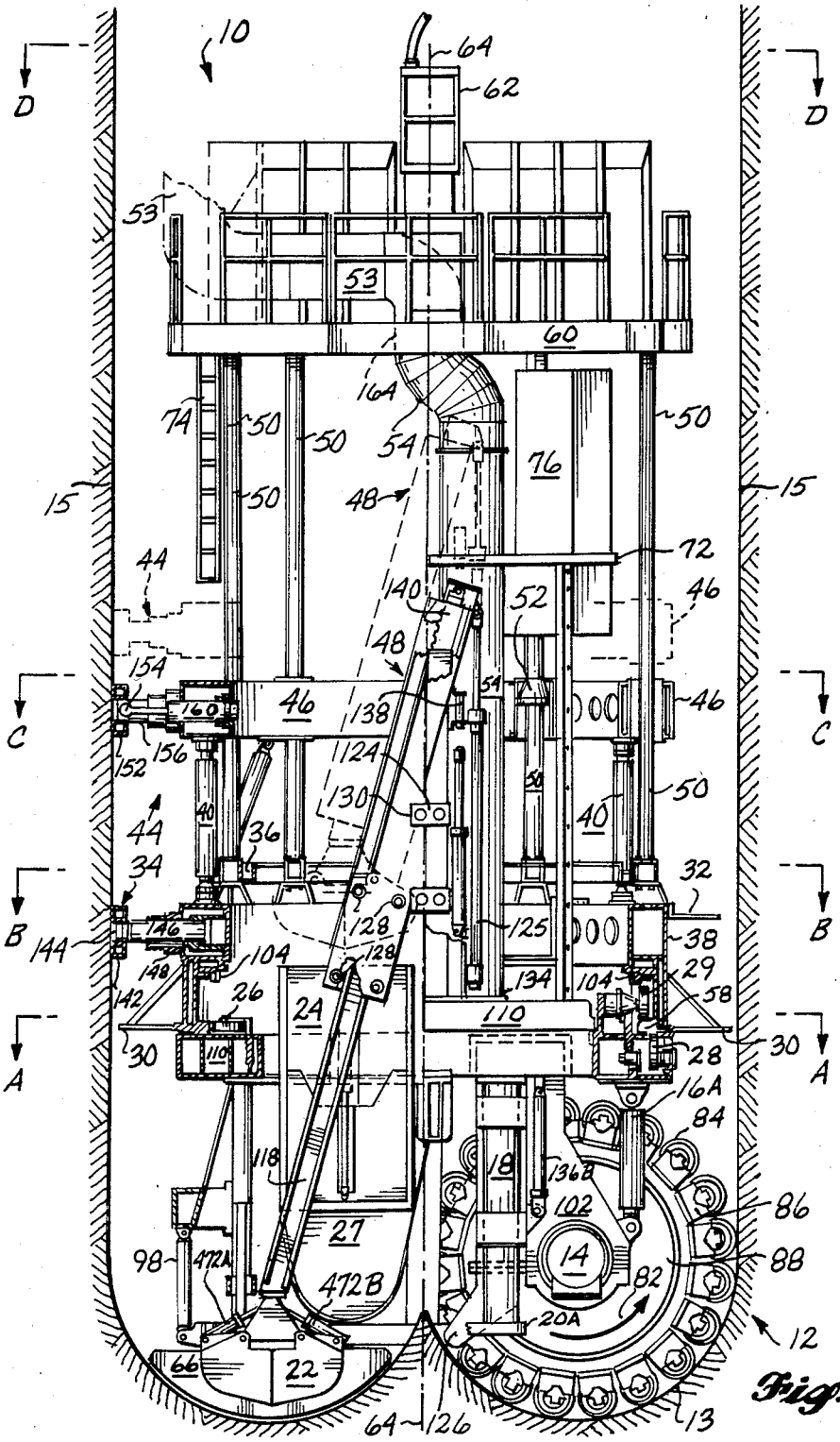
FIG. 1 is a side elevational view of one typical embodiment of a shaft boring machine constructed according to the present invention, with portions shown in cross section.

Referring to FIG. 1, in general the shaft boring machine 10 can be divided into an outer stationary or non-rotating section and an inner rotating section. The cutting, mucking, and control units are mounted on the rotating section. The stationary section grips the vertical walls of the shaft 15 to support the cutterwheel assembly 12, to react the cutting loads, and to provide the means of advancing and steering. Three sets of rollers 26, 28 and 29 attached to the inner rotating section running on a track 58 integral with the outer stationary section provide the rotary bearing connection between the sections. Hydraulic slew rotation drives 106 (FIG. 6) on the inner rotating section engaged with a ring gear 104 mounted above the track 58 provide the slewing motion. The cutterwheel assembly 12 is mounted with its axis horizontal and the cutterwheel assembly 12 rotates in a vertical plane, thereby cutting out a semi-toroidal shape in the rock work face 13 as it is slewed around the vertical axis 64 of the machine 10. The direction of rotation in the vertical plane of the cutterwheel assembly 12 is counterclockwise as shown by the arrow 82 in FIG. 1.

The normal sweeping action of the cutterwheel assembly 12 will tend to radially distribute the rock cuttings (or muck) from the bottom of the rock work face 13 outwardly for some distance (approximately 60 degrees) to the outside. A plow 21 (FIG. 6) follows behind the cutterwheel assembly 12 and is in contact with the work face. The plow 21 pushes the rock cuttings in towards the center of the shaft 15 as shown by the arrows 35 in FIG. 3 where the rock cuttings form a muck pile 23 (FIG. 6) on the bottom of the work face 13.

The rock cuttings are then scooped from the muck pile 23 by a boom-mounted clam shell bucket 22 and loaded into a hopper 24 mounted in the inner rotating section. A scraper unit 66 trailing the loading point of the clam shell 22 collects and piles up any cuttings not removed.

Figure 4:
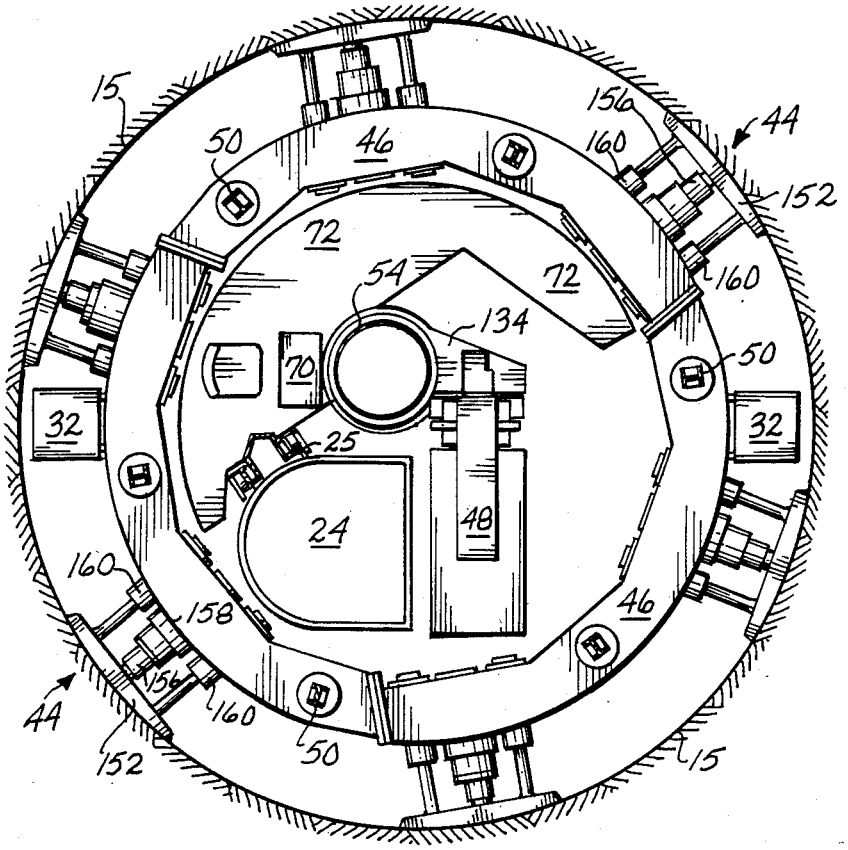
FIG. 4 is a top view of the typical embodiment of the present invention illustrated in FIG. 1, taken along line C—C thereof.

There are two sets of grippers, a lower gripper system 34 and an upper gripper system 44, on the stationary section which provide the load reaction and advancing functions. An upper stationary deck 60 is supported by support columns 50 from the lower gripper ring 38. The machine operator's console 70 (FIG. 4) is mounted on the upper deck 72 of the rotating section.

Figure 6:
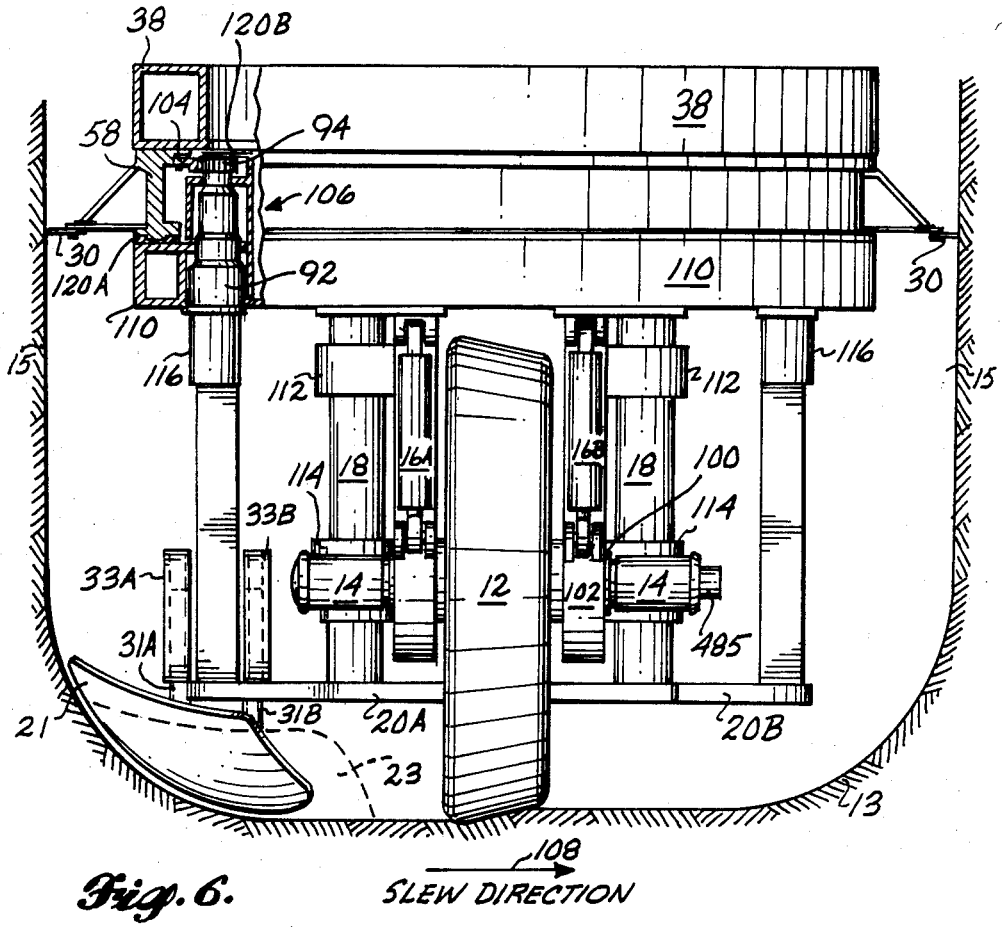
FIG. 6 is a side elevational view of the lower portion of the shaft boring machine illustrated in FIG. 1, schematically showing construction of the cutterwheel assembly and showing the slew drive and a portion of the slewing base frame in cross section.

A number of standard tunnel boring machine rolling disc cutters 84 are mounted on the periphery of the cutterwheel assembly 12. These are preferably hard rock rolling disc cutters about 10 to 18 inches in diameter of the general type disclosed in Sugden U.S. Pat. No. 3,787,101 issued Jan. 22, 1974, for example. Alternatively, the rolling cutter units 84 may be rolling button cutters of the general type disclosed in Sugden U.S. Pat. No. 4,381,038 issued Apr. 26, 1983. The cutters 84 are arranged in a multi-helical pattern so as to progressively cut a bevelled or ramp profile (FIG. 6) in the rock work face 13 as the cutterwheel 12 is slewed around. There are also four additional cutters (not shown) at the trailing edge of the cutterwheel 12 arranged to cut away material that would otherwise interfere with the pedestal mounting of the outermost rolling cutter units 84. As shown in FIG. 6, the cutterwheel 12 has a bevelled cross-sectional configuration with a slightly increasing diameter in the trailing portion thereof The cutters 84 are arranged so as to maintain nearly uniform penetration and maximum cutting efficiency. Because of the combination of cutterwheel rotation and slewing action, the cutting pattern varies with distance from the machine centerline (slewing axis) 64 which is concentric with the vertical axis of the shaft. The cutters 84 are mounted on pedestals 86 welded to the cutterwheel body 88 and are easily removable. Scrapers may be mounted between the cutters to deflect the cuttings and reduce unnecessary recutting of material.

The cutter arrangement is similar to that used on the mobile mining machine described in pending Sugden et al U.S. patent application Ser. No. 558,784 filed Dec. 6, 1983, now U.S. Pat. No. 4,548,442 issued Oct. 22, 1985, although that cutterwheel has bi-directional horizontal movement whereas the present cutterwheel 12 is unidirectional. As stated previously, the cutters 84 are mounted in a multi-helical arrangement. Looked at from the edge, the cutting profile is in the form of a ramp (FIG. 6). This enables a cut of about two to four inches in depth in a single pass, although the penetration of each individual cutter is within the normal range of about $\frac{1}{4}$ to $\frac{3}{8}$ inch.

There are two main advantages in using the cutterwheel-on-edge design. The first advantage is that it provides sufficient space for the operation of the primary mucking system. The second advantage is that the basic machine can be adapted to cut shafts over a range of diameters by adjusting the location of the cutterwheel assembly 12 and by changing its diameter.

The cutterwheel body 88 (FIG. 1) is comprised of three sections: an inner drum section which is mounted with tapered roller bearings on a hub assembly; and two outer segments which carry the cutter pedestals 86. The outer segments can be of various sizes to provide cutterwheels of different diameters. The inner section-hub assembly is designed to be transportable underground. This means that seals and bearings need not be disturbed in an adverse environment. The hub section is clamped into a carriage unit 102, which is in turn mounted on a pair of vertical cylindrical guide columns 18. The guide columns 18 permit the plunging action of the cutterwheel assembly 12.

The cutterwheel 12 is driven by two symmetrically opposed electric motors 14 connected to planetary speed reducers 100 (FIG. 6) which are mounted within the hub unit. The reducer outputs drive a common pinion, which transmits torque via a set of idler gears to a ring gear integral with the inner drum section.

Figure 2:
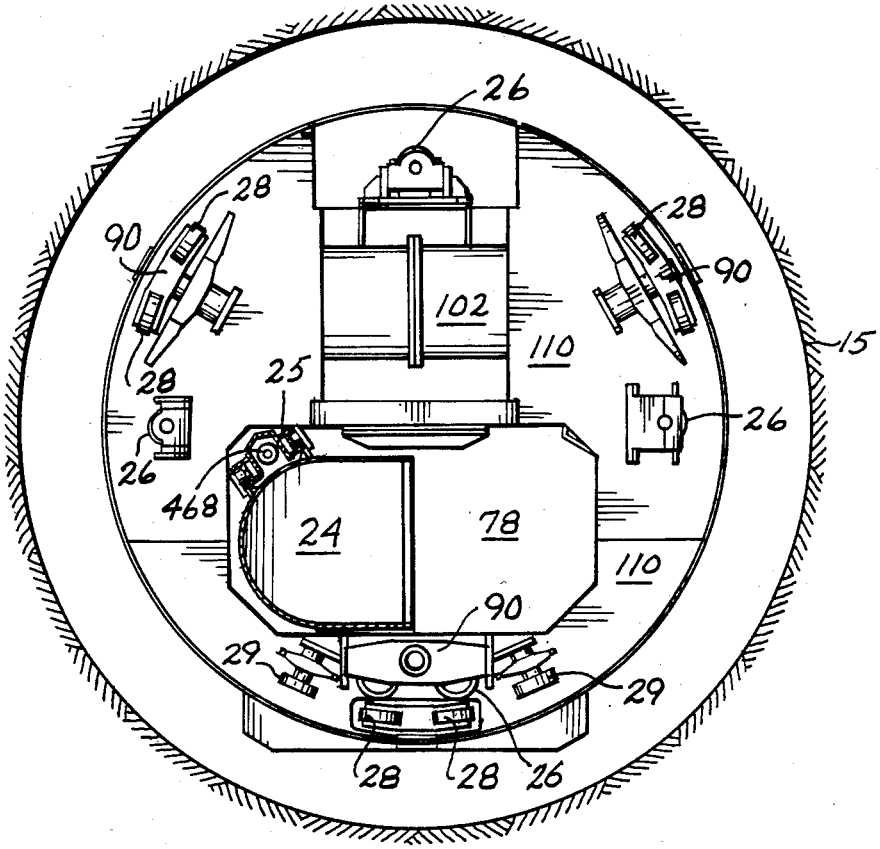
FIG. 2 is a top view of the typical embodiment of the present invention illustrated in FIG. 1, taken along line A—A thereof.

The gear drives are splash lubricated. Heavy duty seals are used to retain the oil and prevent ingress of dirt and water. The guide columns 18 (FIG. 6) are connected on both ends to the slewing base frame 110, directly at the top ends, and indirectly at the bottom through bracing, including horizontal guide column supports 20A and 20B, and vertical support columns 56 and 57 (FIG. 6), forming the clam bucket well 78 (FIG. 2). The plow 21 (FIG. 6) is mounted on the vertical posts 31A and 31B which slide up and down in their respective vertical support slides 33A and 33B mounted on the guide column support 20A. In this way, the plow 21 remains in contact with the work face 13 as slewing proceeds. The radial location of the guide columns 18 and hence the cutterwheel axis can be moved outwardly when boring larger diameter shafts. The vertical position of the cutterwheel carriage 102 is controlled by two symmetrically mounted plunge cylinders 16A and 16B attached to the slewing base frame 110.

The drive motors 14 are water cooled. An excessively dusty environment precludes fan cooling and the motors 14 are designed to tolerate immersion in water in the event of excessive water inrush at the shaft bottom. The cooling water may be used for dust suppression after passing through the motors 14 or it may be recirculated through an air radiator type heat exchanger to eliminate the requirement of a water supply to the rotating section.

The slewing base frame 110 supports the cutterwheel assembly 12 and the muck removal unit 48. The slewing base frame 110 is supported by the upper axial slew rollers 29 running on the stationary track 58 which is integral with the lower gripper ring 38. Vertical loads are carried by the three pairs of the lower axial slew rollers 28 (FIG. 2) arranged symmetrically around the slewing base frame 110. The lower axial slew rollers 28 and the upper axial slew rollers 29 run on individual portions of track 58 to resist upward and downward forces. In order to reduce track loading, dual roller sets mounted on equalizing beams 90 (FIG. 2) are used. Radial location of the base frame slewing 110 is achieved by the radial slew rollers 26 having their axes vertical. The track 58 is run dry. The slew roller bearings are grease lubricated. The slewing base frame 110 breaks down into a number of sections for underground handling.

The slew drive 106 (FIG. 6) consists of four hydraulic motors 116 mounted to gear reducers 92, the output pinions 94 of which engage with the stationary ring gear 104. Roller track 58 and ring gear 104 are in a sealed enclosure to prevent ingress of dirt. Seals 120A and 120B perform the sealing function. The gear 104 is lubricated with a film-type lubricant which is adequate at the very low slewing speeds.

The muck scraper 66 (FIG. 1) is pivoted at point 126 from the cutterwheel carriage 102. The muck scraper hydraulic cylinder 98 is used to maintain the scraper 66 in contact with the face.

Figure 3:
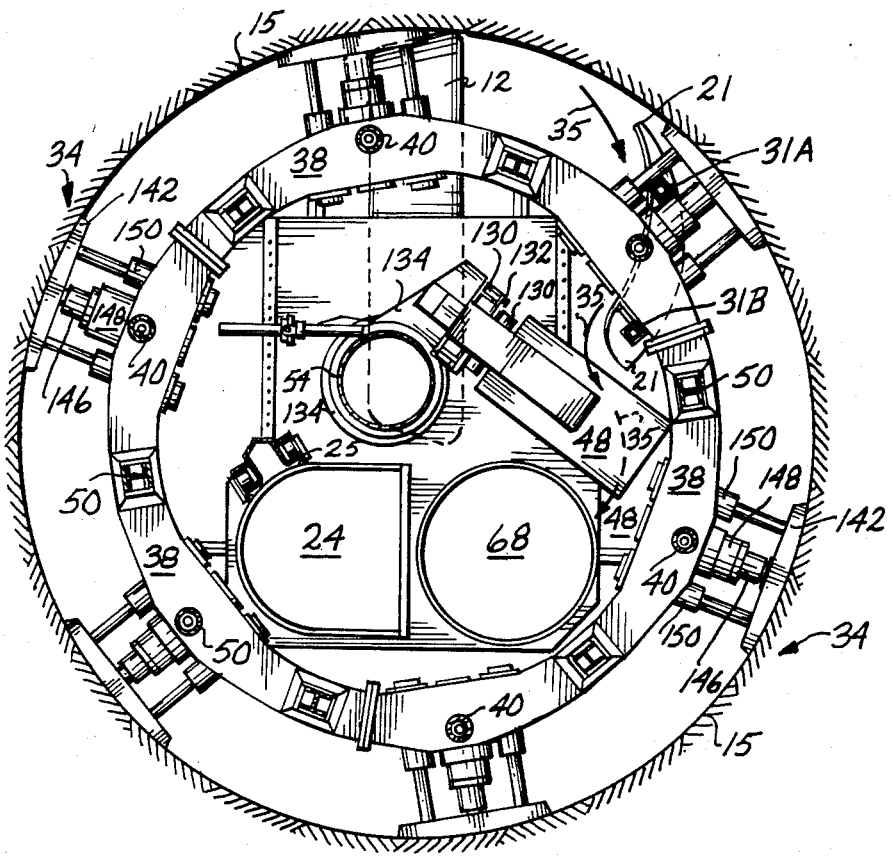
FIG. 3 is a top view of the typical embodiment of the present invention illustrated in FIG. 1, taken along line B—B thereof.
Figure 7:
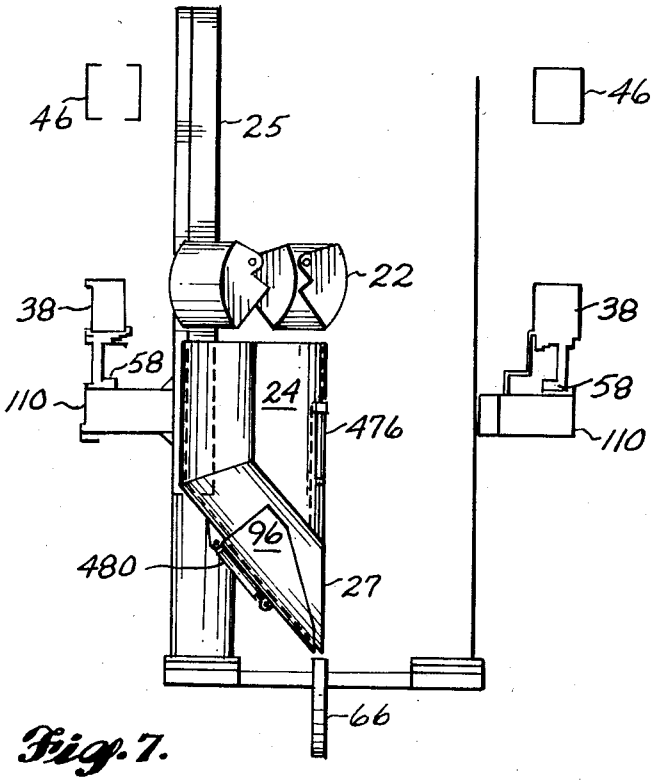
FIG. 7 is a schematic view of the hopper loading system.

The muck removal unit 48 (FIG. 1) consists of a clam shell bucket 22 fixedly mounted at the end of an extendible boom 118. The boom 118 is mounted on rollers 128 in a carriage unit 124 which in turn moves vertically on rollers 130 on track 132 (FIG. 3). The carriage 124 is moved up or down by the action of the carriage hydraulic cylinder 125. When the carriage 124 is at its upper position as shown by the phantom lines in FIG. 1, it can rotate in either of two directions. One direction swings the clam shell 22 over the hopper 24 to permit dumping as shown in FIG. 7, while the other direction rotates the entire muck removal unit 48 into a storage position as shown in FIG. 3 so that it is clear of the incoming empty muck bucket 68 during muck bucket transfer. All motions are accomplished hydraulically. The entire mucking cycle is automatically controlled with the aid of limit switches and solenoid valves. The presence of the muck scraper 66 (FIG. 1) makes it unnecessary to scrape the face clean with the clam shell 22 as material left over will pile up to be collected during succeeding fillings.

The boom support carriage track 132 (FIG. 3) is mounted on a frame 134 that swings on bearings concentric with the ventilation duct 54. The downward travel of the carriage 124 is limited by the carriage stroke limit cylinder 136.

The carriage stroke limit cylinder 136A is connected in a push-pull relationship to a corresponding cylinder 136B connecting the cutterwheel carriage 102 to slewing base frame 110. This ensures that the clam shell 22 is in the correct position for pickup when the boom 118 is completely extended. Controlled deceleration of the boom 118 and carriage 124 motions are achieved hydraulically by control of the fluid flow and by externally fitted shock absorbers, one of which is shown at 138, for example.

The boom 118 is a square box in cross-section and it slides within the carriage unit 124 on the rollers 128. The hydraulic actuating cylinder 140 is located along the axis of the boom. Hydraulic fluid to actuate the clam shell 22 is supplied via a flexible hose line (not shown).

The lower gripper system 34 (FIGS. 1 and 3) will now be described. This lower gripper system 34 provides the main resisting forces to rock cutting forces which can be divided into vertical, horizontal, and torsional components. Six equally spaced arcuate gripper pads 142 are used to provide adequate bearing against the wall while also allowing for occasional voids. The gripper pads 142 are mounted via ball joints 144 to guide rods 146 sliding in the gripper support structures 148. The guide rods 146 carry the lateral forces. A pair of hydraulic cylinders 150 (FIG. 3) provide the thrust for each pad 142. The lower gripper ring 38 (FIG. 3) is a complete ring-shaped support structure having a box-like cross-sectional construction as shown in FIG. 1 to provide torsional and radial strength. The slew roller track 58 (FIG. 1) and the ring gear 104 (FIG. 1) are integral with the lower gripper ring 38, assuring a very rigid assemblage. The lower gripper ring 38 can be split into three equal sections to permit underground transport.

The upper gripper system 44 (FIGS. 1 and 4) is next described. The upper gripper system 44 provides a temporary anchor for the machine during the advance or regrip operation. It also supplies backup stabilization to the lower gripper system 34 during the cutter operation via the six vertical walking cylinders 40 which connect the upper gripper ring 46 and lower gripper ring 38. Six equally spaced arcuate gripper pads 152 are used to provide adequate bearing against the bore wall. The gripper pads 152 are mounted via ball joints 154 to hydraulic cylinders 160 (FIG. 4) which provide the thrust for each pad 152. The gripper pads 152 are also mounted via ball joints to guide rods 156 sliding in the gripper support structures 158. The guide rods 156 carry the lateral forces. The upper gripper ring 46 is not directly attached to the stationary upper deck 60 of the machine. The support columns 50 which support the upper deck 60 pass through the upper gripper ring 46 and centering collars 52 on the support columns 50 locate the upper gripper ring 46 when the walking cylinders 40 are retracted. Two roll correction cylinders 42 are diagonally connected between the upper gripper ring 46 and the lower gripper ring 38. The upper gripper ring 46 also splits into three equal sections.

An exhaust system is used for ventilation, incorporating a fan at the surface. At the machine, the stationary vent duct 53 is located above the upper deck 60. The stationary duct 53 is converted to the rotating vent duct 54 at the rotary joint 164 on the machine axis 64. The rotating vent duct 54 terminates at the slewing base frame 110. The incoming air is forced via the clam bucket well 78 close to the work face, which assures a scouring action to carry away hazardous gases. The forced air flow also carries away dust generated by the cutting action. The ventilation duct 54 on the machine is also used as a structural element contributing support to the operator's deck 72 and the mucking unit boom support frame 134 (FIG. 3). A telescoping section (not shown) of vent line on the service stage above the machine 10 permits advance of the machine relative to the fixed ducting. When the telescoping unit has been fully extended, it is retracted and another fixed section added.

In very dry conditions it may be necessary to spray water in the face area to provide additional dust control. It is anticipated that normally the shaft bottom will be at least damp.

The machine operator's console 70 (FIG. 4) is situated on the rotating operator's deck 72. The console 70 incorporates controls for the drive, slew, and plunge operations of the cutterhead 12 and for the operation of the muck removal unit 48 The muck removal unit 48 is run on an automatic cycle, but startup, park, and manual override controls are required. Indicators and gauges on the console are installed to monitor the operation of the electrical and hydraulic systems.

The controls for the gripping, advancing, and steering systems are mounted on the stationary support columns 50. The hydraulic power unit 80 (FIG. 5) for these functions is mounted on the upper deck 60. The controls are located at a position accessible by the machine operator and from which the laser targets 32 (FIG. 4) and inclinometer can be viewed.

For speed and ease of control, the majority of control valves used on the muck removal unit 48 are solenoid operated, energized via limit switches. Controls for the remainder of the hydraulics are mechanical, either direct operating or remotely piloted as described in greater detail below.

The electrical system is explosion proof to U.S. coal mine standards. Operating voltage is suitably 950 volts. The majority of electric power is used on the rotating section of the machine and a three-phase explosion proof electrical swivel 62 (FIGS. 1 and 5) is employed. The electrical swivel 62 is mounted above the vent duct rotary joint 164 on the upper deck 60. Control and lighting voltages are 120 volts.

There are two independent hydraulic systems, one for the rotating section and one for the stationary section. The hydraulic system for the rotating section is the largest, the main power consumers being the muck removal unit 48 and the slew drives 106. The hydraulic system for the stationary section serves to actuate the gripper and advance systems. The hydraulic system fluid is water glycol and the maximum operating pressure is 2800 psi. The slew drives 106 employ a variable displacement pump to permit slew speed variation with varying rock conditions.

Figure 9A:
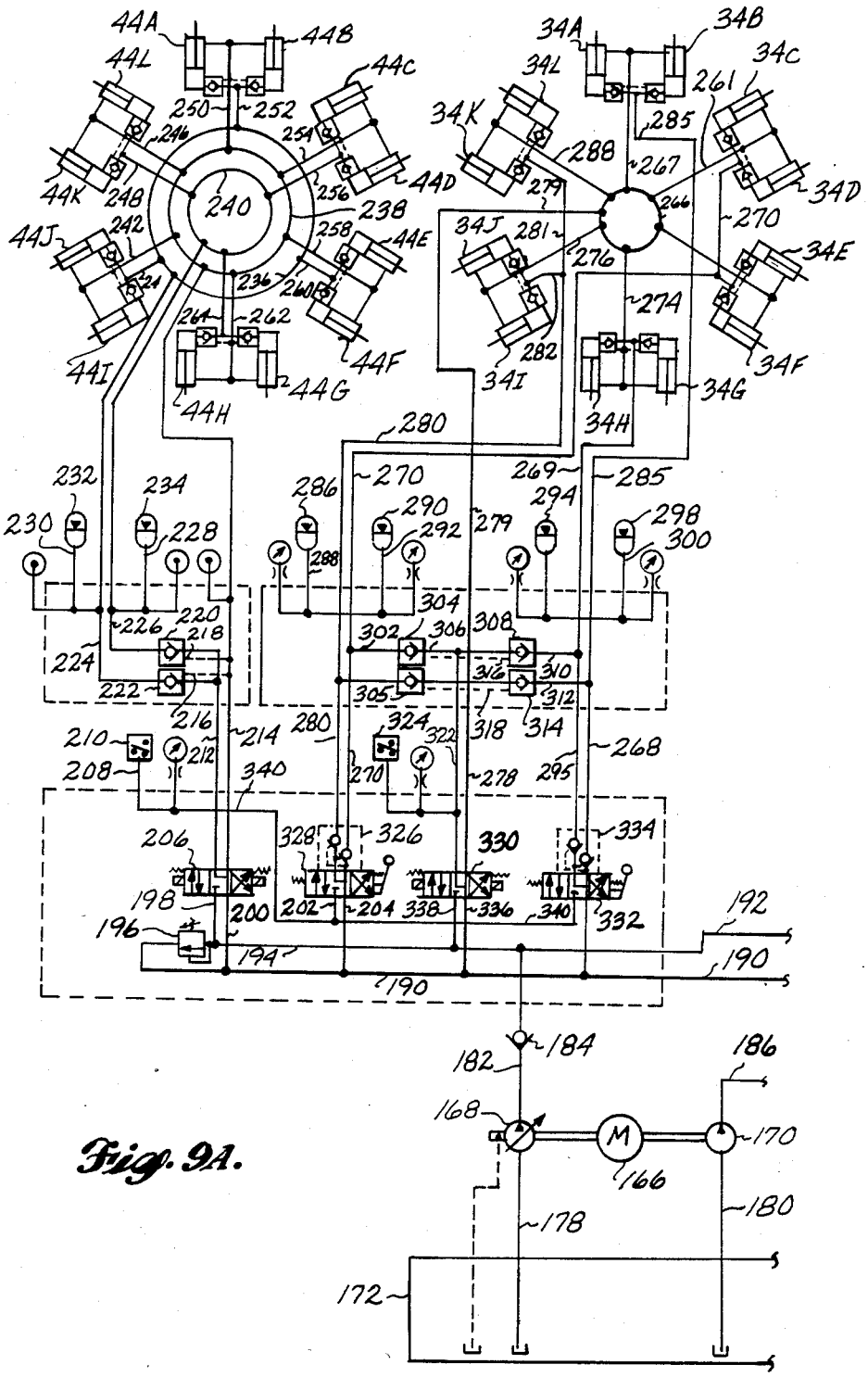
FIGS. 9A and 9B are a schematic representation of a simplified version of the hydraulic control system for the outer stationary section of the shaft boring machine illustrated in FIG. 1.
Figure 9B:
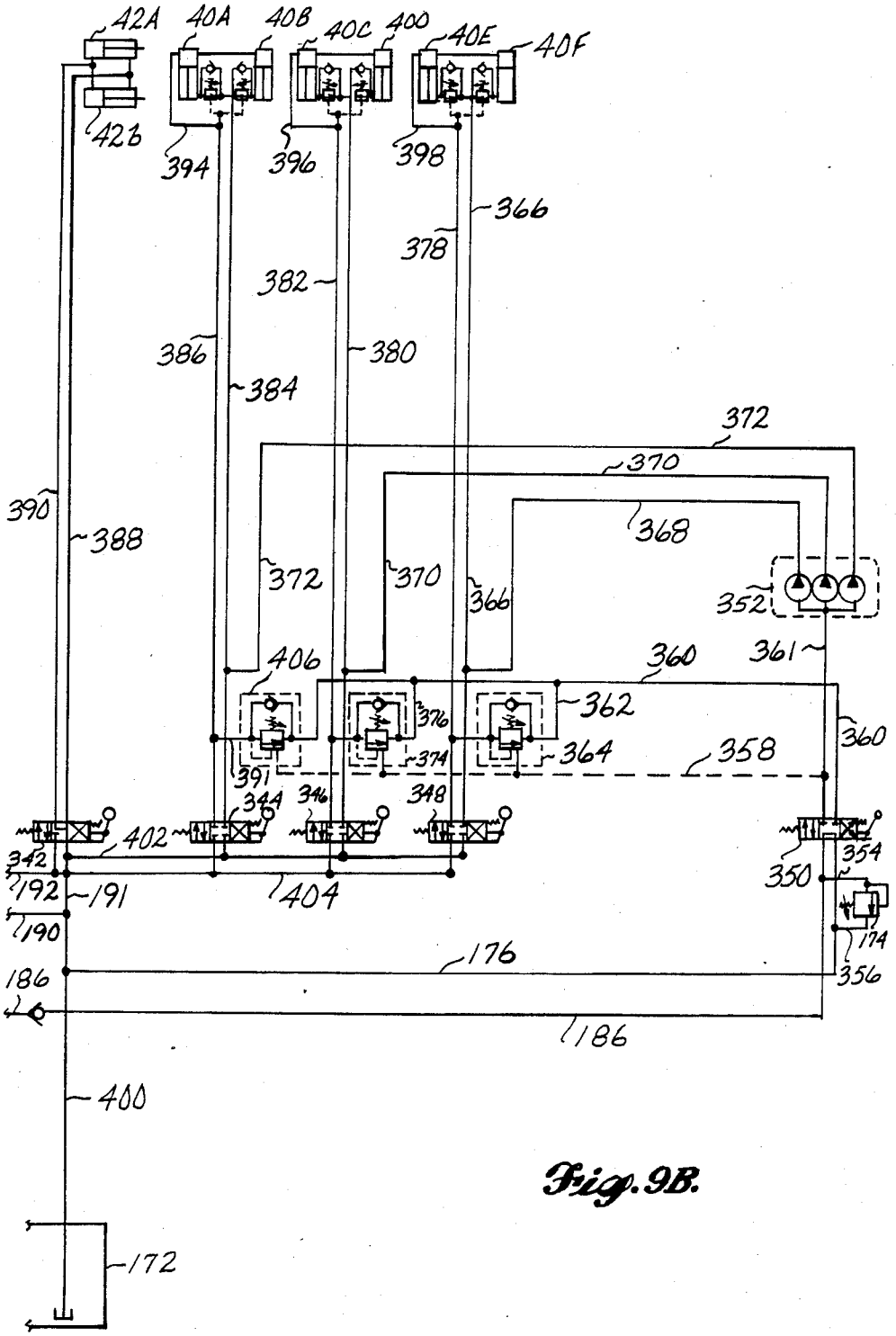

The hydraulic control systems are next described in more detail. FIGS. 9A and 9B are a simplified schematic representation of the hydraulic control system for the stationary section of the shaft boring machine 10. FIGS. 9A and 9B show the hydraulic control system for the upper gripper cylinders 44A–44L, the lower gripper cylinders 34A–34L, the roll cylinders 42A and 42B, and the walking cylinders 40A–40F which are used for lowering and raising the machine 10 on the shaft wall. The roll cylinders 42A and 42B control the attitude or azimuth of the machine as it goes down the shaft. Motor 166 is an electric motor of 50 horsepower which drives pumps 168 and 170. Pump 168 is a low capacity variable displacement pump and pump 170 is a high capacity fixed displacement pump. Pump 168 supplies a low volume at high pressure. Pump 170 supplies a high volume of hydraulic fluid at low pressure. Pump 168 is a pressure compensated pump which maintains a selected pressure and adjusts to produce no flow while the pressure is maintained. This type of pump is especially useful for the upper gripper cylinders 44A–44L and the lower gripper cylinders 34A–34L because when the grippers are extended the object is to hold them in their extended position by maintaining the hydraulic pressure. By contrast, pump 170 is a high flow pump used for fast resetting. For example, if the operator desires to retract either set of gripper cylinders, high pressure is not required to retract the gripper cylinders but it is desirable to do it quickly. Therefore, the high flow pump 170 supplies the hydraulic fluid to accomplish the quick retraction of the gripper cylinders. Tank 172 has a capacity of one hundred and fifty gallons.

Considering the control of the upper gripper cylinders 44A–44L, the fluid from pump 168 goes through line 182 through check valve 184 into lines 192 and 198 to valve 206. Valve 206 is a solenoid actuated directional control valve. Shifting valve 206 to the right feeds pressurized fluid to the head end of each of the twelve upper gripper cylinders 44A–44L and extends their rods. This is accomplished by feeding pressurized fluid through the line 212 to the pilot-operated check valves 220 and 222 and then through lines 224 and 226 to the outer ring 236 and the inner ring 240 which feed the fluid to the head ends of the upper gripper cylinders 44A–44L via the pilot-operated check valves associated with the head end of each cylinder. The inner ring 240 feeds the cylinders 44C, 44D, 44G, 44H, 44K, and 44L. The outer ring 236 feeds the cylinders 44A, 44B, 44E, 44F, 44I, and 44J. At each pair of hydraulic cylinders, the pressurized fluid extends both cylinders simultaneously.

The separate feed rings are a safety feature. The machine is capable of supporting itself when only three pairs of the upper gripper cylinders are operating. Thus, in case one of the supply lines fails, the other supply line feeding the other three pairs of upper gripper cylinders can support the machine. The accumulators 232, 234, 286, 290, 294, and 298 are another part of the safety system and their purpose is to maintain the pressure in the system if the pump should fail or if an electrical failure should occur that causes the pump to stop.

When the operator desires to retract the upper gripper cylinders 44A–44L, valve 206 is shifted to the left. Pressurized fluid is then fed through line 214 to lines 216 and 218 to pilot open the check valves 220 and 22. Pressurized fluid is also fed through line 215 to the middle ring 238 which in turn feeds the rod end of each cylinder and the pilot lines going to each of the pilot-operated check valves associated the head end of with each of the upper gripper cylinders. With these check valves piloted open, fluid flows out of the head end of each cylinder through the check valves and ultimately back to tank.

Valve 330 controls the lower gripper cylinders 34A–34L. Valve 330 is another solenoid actuated directional control valve. Shifting valve 330 to the right feeds pressurized fluid to the head end of each of the twelve lower gripper cylinders 34A–34L and extends their rods. This is accomplished by feeding pressurized fluid through line 322 to the four of the pilot-operated check valves 304, 305, 308, and 314. The fluid then feeds through the lines 269, 270, 280, and 285 to the head end of each of the lower gripper cylinders 34A–34L via the pilot-operated check valves which are associated with the head ends of each cylinder. The pressurized fluid in line 270 from check valve 304 feeds cylinders 34C, 34D, 34E, and 34F. The pressurized fluid in line 280 from check valve 305 feeds cylinders 34I, 34J, 34K, and 34L. The pressurized fluid in line 269 from check valve 308 feeds cylinders 34G and 34H. The pressurized fluid in line 285 from check valve 314 feeds cylinders 34A and 34B. At each pair of hydraulic cylinders, the pressurized fluid extends both cylinders simultaneously.

The manually operated directional control valve 328 is used for left/right steering. It controls the extension of cylinders 34C, 34D, 34E, and 34F for moving the lower gripper ring 38 to the left and the extension of cylinders 34I, 34J, 34K, and 34L for moving the lower gripper ring 38 to the right. Manually operated directional control valve 332 controls fore/aft steering. Moving valve 332 to the right feeds pressurized fluid through line 295 to line 269 to extend cylinders 34G and 34H for moving the lower gripper ring 38 in the fore direction. Moving valve 332 to the left feeds pressurized fluid through line 268 to line 285 to extend cylinders 34A and 34B for moving lower gripper ring 38 in the aft direction. The double pilot-operated check valves 326 and 334 allow fluid flow to the cylinders from valves 328 and 332 but no flow in the opposite direction until the check valves are piloted open.

Pressure switches 210 and 324 are a safety feature so that both sets of gripper cylinders can not be released at the same time. Pressure switch 210 ensures that the upper gripper cylinders 44A–44L are pressurized before the lower gripper cylinders 34A–34L can be retracted. Pressure switch 324 ensures that the lower gripper cylinders 34A–34L are pressurized before the upper gripper cylinders 44A–44L can be retracted. Otherwise the machine 10 could drop down the shaft if both sets of gripper cylinders were to be retracted at the same time.

Turning now to the walking cylinders 40A–40F, the pressurized fluid from pump 168 and the pressurized fluid from pump 170 can all go to the walking cylinders 40A–40F depending on which operation is being performed. The walking cylinders 40A–40F can all be operated simultaneously or each of the three pairs can be operated individually in order to level the machine 10. The three pairs of cylinders are arranged in an equilateral triangle arrangement on the machine 10 in order to give a three point suspension system. The manually operated directional control valves 344, 346, and 348 are the controls for each pair of walking cylinders respectively.

The manually operated directional control valve 350 is the up/down fast speed control valve. If valve 350 is shifted to the right, pressurized fluid from valve 350 goes through line 361 and enters the fluid flow divider 352. The fluid flow then divides and goes through lines 368, 370, and 372 to the rod end of each walking cylinder to retract each of the cylinders and thereby lower the upper gripper ring 46. The flow divider 352 is necessary because the loading on the walking cylinders 40A–40L is not equally divided. The side of the machine having the cutterhead 12 is heavier than the other side. In other words, the center of gravity of the machine 10 is not on the center line 64 of the machine. The line 186 coming from pump 170 to valve 350 is a high volume line in order to achieve the fast speed up/down movement of the walking cylinders 40A–40F. The counterbalance valves 364, 374, and 406 prevent uncontrolled retraction of the cylinders under the gravity load of the upper gripper structure.

If valve 350 is shifted to the left, pressurized fluid is admitted to the head end of each cylinder to extend each cylinder and thereby lower the machine 10. There is a counterbalance valve associated with the rod end of each walking cylider 40A–40F. These counterbalance valves control the lowering of the machine 10 while supported by the upper gripper system 44.

The roll cylinders 42A and 42B are used to correct the orientation of the machine 10. They serve to rotate one gripper ring with respect to the other gripper ring and allow the machine to be rotated in the shaft about axis 64 if correction is required. The roll cylinders 42A and 42B are controlled by manually operated directional control valve 342.

Figure 10A:
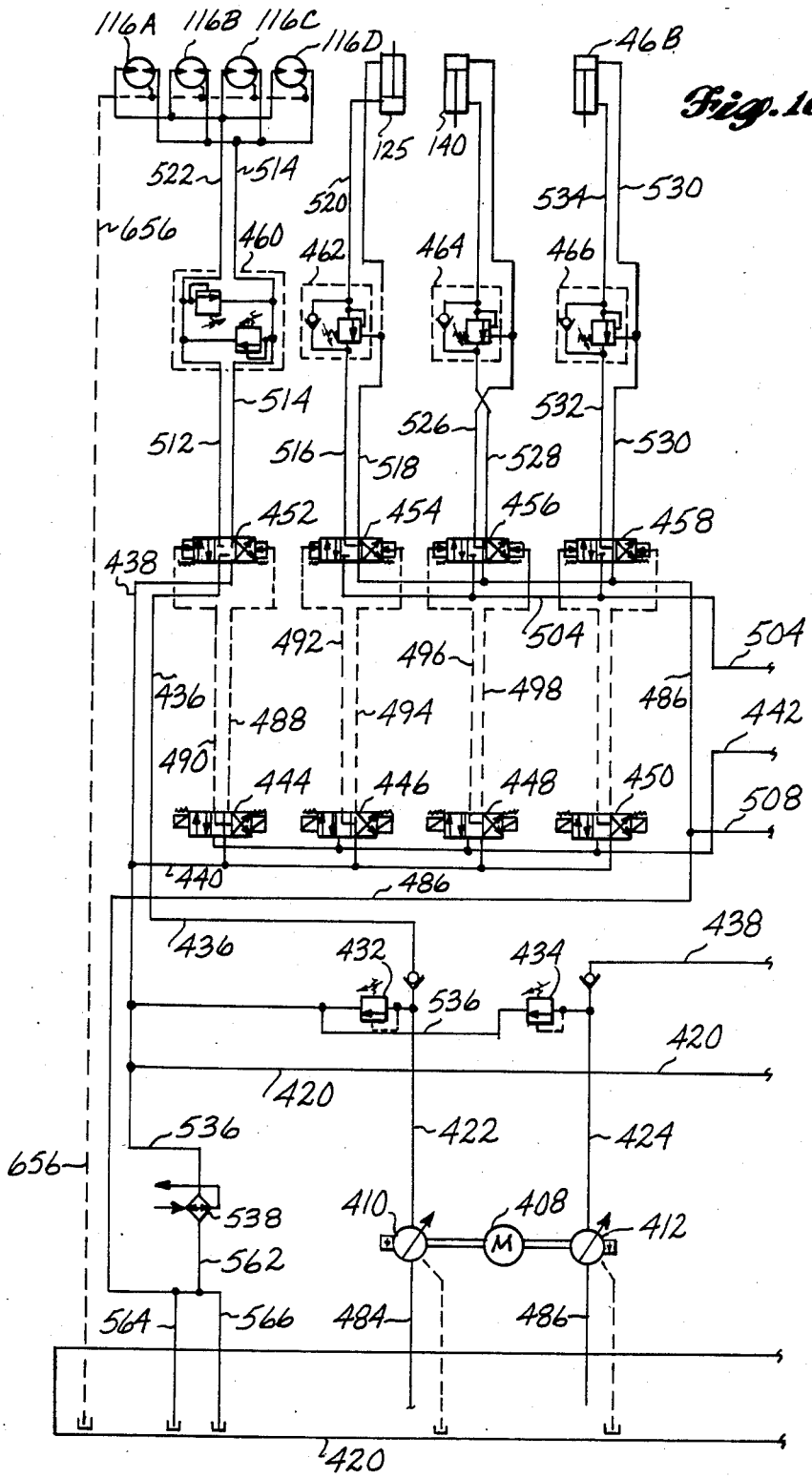
FIGS. 10A, 10B, and 10C are a schematic representation of a simplified version of the hydraulic control system for the inner rotating section of the shaft boring machine illustrated in FIG. 1.
Figure 10B:
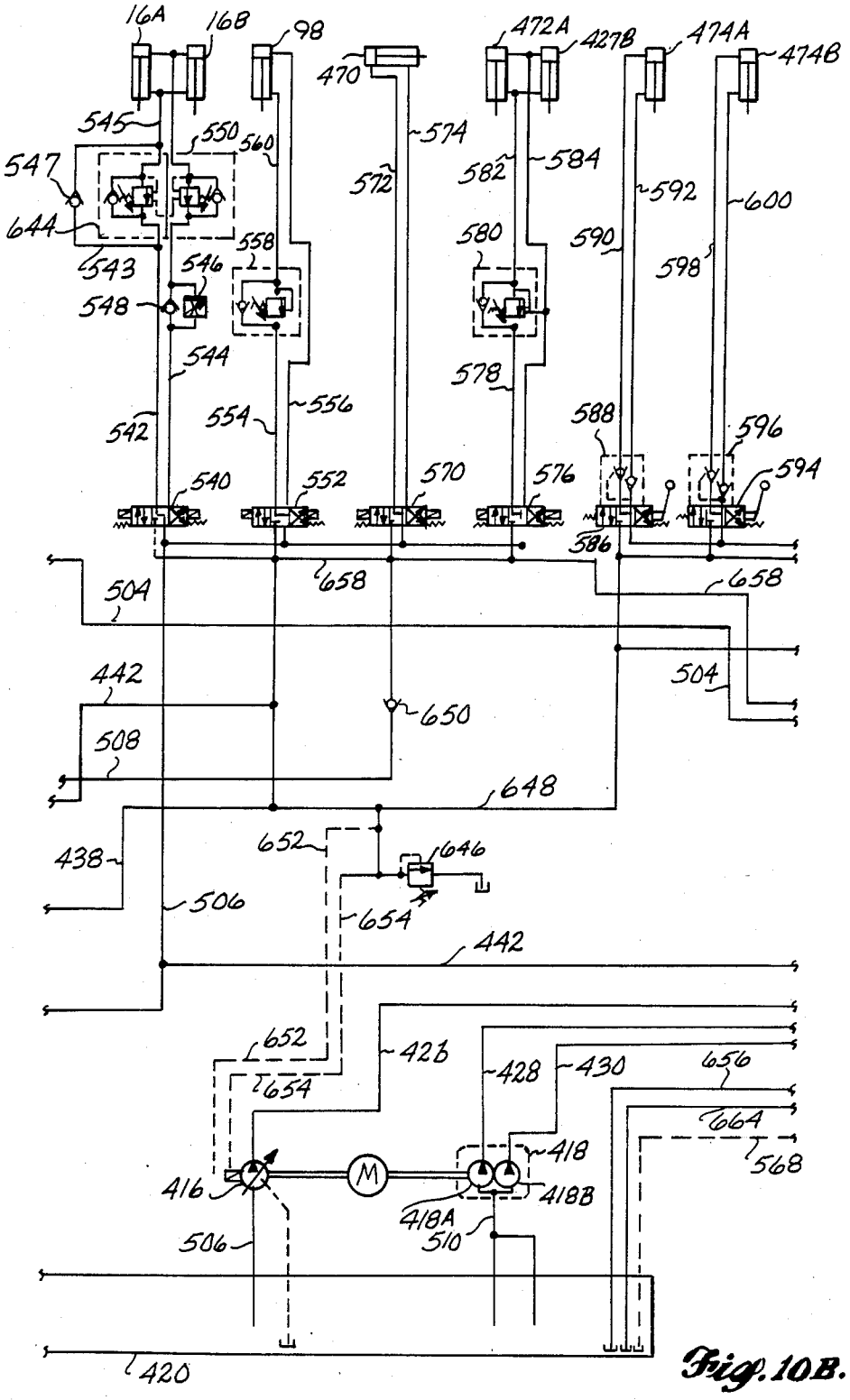
Figure 10C:
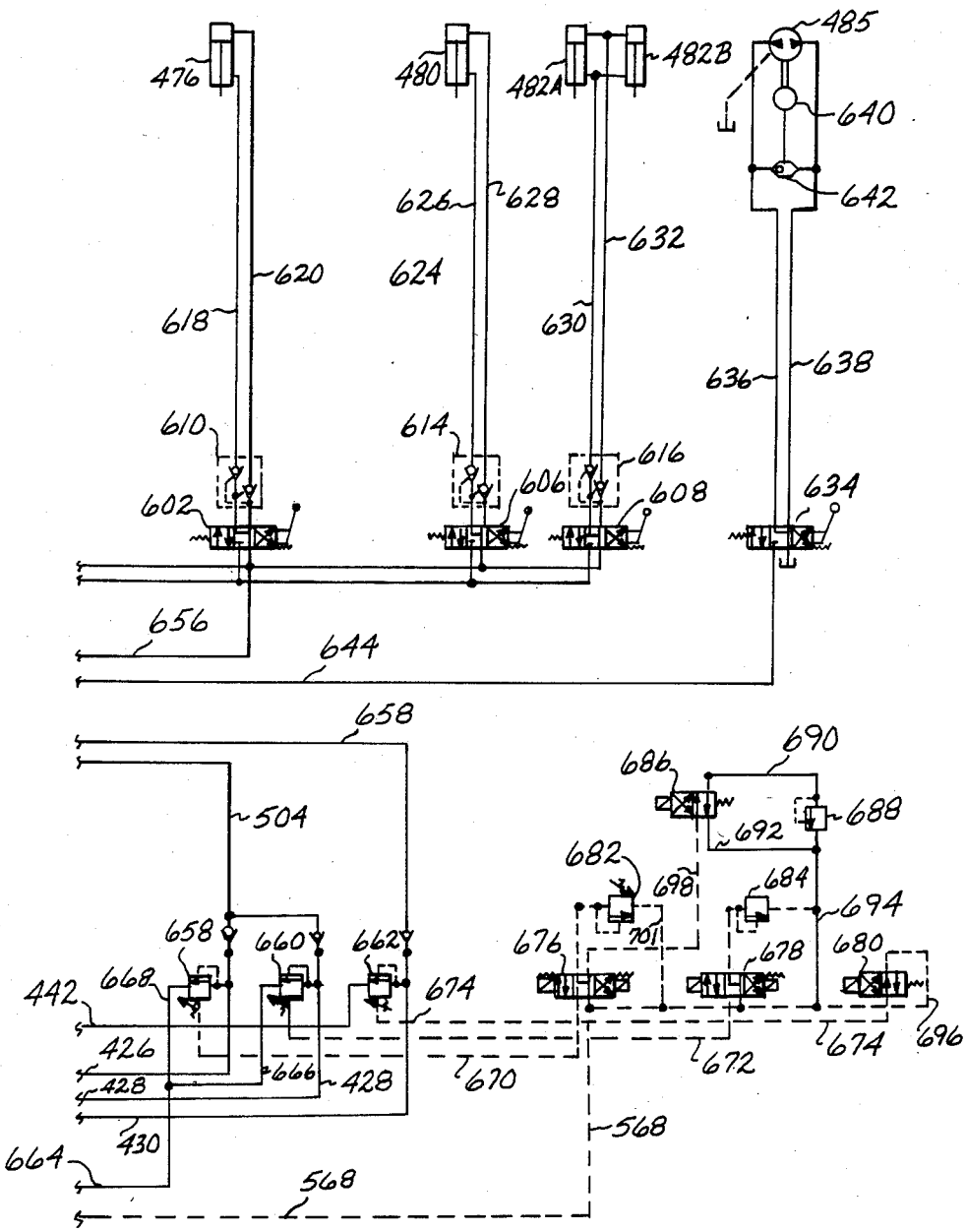

FIGS. 10A, 10B, and 10C are a simplified schematic representation of the hydraulic control system for the rotating section of the shaft boring machine 10. This system has a five hundred gallon reservoir tank 420. There are four pumps in this system. The first pump is the variable displacement pump 410. Pump 412 is also a variable displacement pump. Pump 416 is another variable displacement pump. Pump 418 is a double fixed displacement pump. It consists of a left side pump **418*a* and a right side pump 418*b*. Motor 408 drives pump 410 and pump 412. Motor 414 drives pumps 416 and 418. Relief valves 432 and 434 protect pumps 410 and 412**.

Heat exchanger 538 removes excess heat from the hydraulic fluid. Due to unavoidable hydraulic inefficiencies, heat is generated in the slewing and mucking hydraulic systems. Pilot operated directional control valve 452 controls the slew rotation motors 116A–116D. Valve 452 is piloted by solenoid actuated directional control valve 444. The motors 116A–116D can rotate in either direction. Relief valve 460 is a crossover relief valve in the motor circuit. If the slew motors 116A–116D stall and cannot rotate, then the crossover relief valve 460 will permit the pressure to be relieved. There is a relief valve in each direction for this purpose. The speed of the slew rotation motors 116A–116D is controlled by controlling the volume output of pump 410. The operator controls the displacement of pump 410 and thereby controls the speed of the slew rotation motors 116A–116D.

The machine support cylinders 474A and 474B are used to support the machine 10 and are controlled by the manually operated directional control valves 586 and 594 which are fed by the low volume pump 412. The circuit is provided with double pilot-operated check valves 588 and 596 to prevent the cylinders 474A and 474B from leaking down.

The inching drive 484 consists of hydraulic motor 485, hydraulic brake 640, and shuttle valve 642. Inching drive 484 is provided so that the cutterwheel 12 can be slowly rotated when needed as, for example, when it is necessary to change the disc cutters 84. The inching drive is controlled by the manually operated directional control valve 634 which is fed by pressurized fluid from pump 412 via lines 424, 438, 648, and 644.

Cutterwheel plunge cylinders 16A and 16B are controlled by solenoid actuated directional control valve 540. Shifting valve 540 to the left extends the rods of cylinders 16A and 16B and plunges the cutterwheel 12. Pressurized fluid flows through line 544 to adjustable flow control valve 546. It is desirable to carefully control the plunge of cutterwheel 12 and that is the purpose of flow control valve 546. The pressurized fluid then flows through the check valve in holding valve 550 to the head ends of cylinders 16A and 16B, thereby extending the rods. The fluid from the rod ends of cylinders 16A and 16B flows through counterbalance valve 644 which is piloted open.

Shifting valve 540 to the right retracts the rods of cylinders 16A and 16B and raises the cutterwheel 12. Pressurized fluid flows through lines 542 and 543 through check valve 547 to the rod ends of cylinders 16A and 16B, thereby retracting the rods. The fluid from the head ends of cylinders 16A and 16B flows through holding valve 550 which is piloted open.

Solenoid actuated directional control valve 552 controls muck scraper cylinder 98. Shifting valve 552 to the left extends the rod of cylinder 98 and lowers the muck scraper blade 66. Pressurized fluid flows through line 556 to the head end of cylinder 98, thereby extending the rod. The fluid from the rod end of cylinder 98 flows through holding valve 558 which is piloted open. The function of holding valve 558 is to control the rate of extension of cylinder 98.

Shifting valve 552 to the right retracts the rod of cylinder 98 and raises the muck scraper blade 66. Pressurized fluid flows through line 554 and through the check valve to the rod end of cylinder 98, thereby retracting the rod.

Carriage swing cylinder 470 is employed to rotate the mucking unit 48 into the dumping position where the clam shell 22 is positioned above the hopper 24. Carriage swing cylinder 470 is controlled by solenoid actuated directional control valve 570.

Clam jaw cylinders 472A and 472B are the cylinders that open and close the clam shell 22. The clam jaw cylinders 472A and 472B are controlled by the solenoid actuated directional control valve 576. The circuit includes holding valve 580 which controls the rate of extension of cylinders 472A and 472B.

Hopper door cylinder 476 is controlled by manually actuated directional control valve 602. The circuit includes pilot-operated double check valve 610 to prevent hopper door cylinder 476 from leaking down.

The hopper door cylinder 476 opens and closes the door on the hopper 24. The hopper door cylinder 476 is controlled by manually operated directional control valve 602. The circuit includes pilot-operated double check valve 610 to prevent the hopper door cylinder 476 from leaking down.

Figure 8:
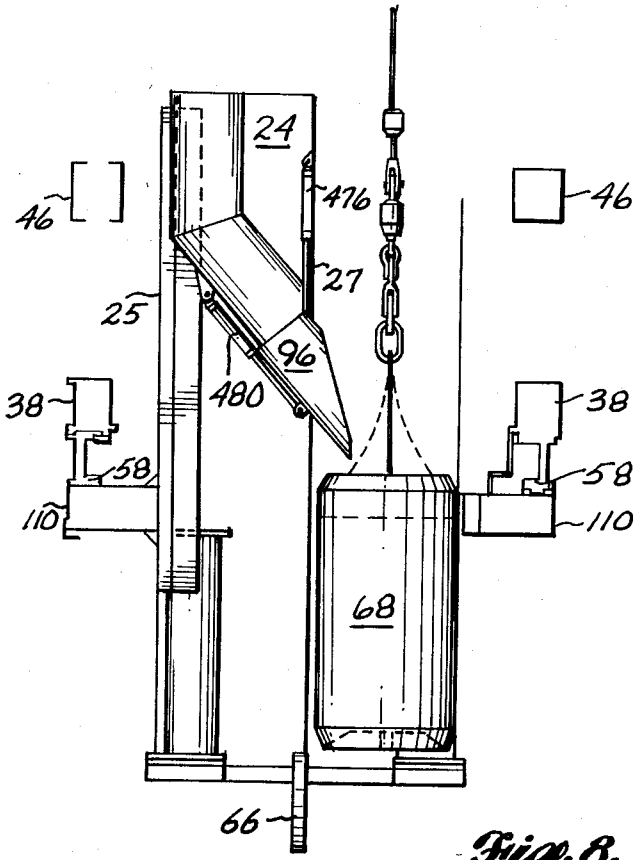
FIG. 8 is a schematic view of the bucket loading system.

The hopper chute cylinder 480 raises and lowers the lip chute which guides the muck from the hopper 24 into the muck bucket 68 during discharge as shown in FIG. 8. The hopper chute cylinder 480 is controlled by the manually operated directional control valve 606. The circuit includes pilot-operated double check valve 614 to prevent hopper chute cylinder 480 from leaking down.

The hopper lift cylinder 468 controls the raising and lowering of the hopper 24 in its track as shown in FIG. 8. Solenoid actuated directional control valve 458 controls hopper lift cylinder 468. The circuit includes counterbalance valve 466 which controls the rate of extension of cylinder 468. The high pressure fluid for operating hopper lift cylinder 468 comes from variable displacement pump 416.

Storage swing cylinders 482A and 482B control the swing of the mucking unit 48 when it goes into its storage position. It should be noted that storage swing cylinders 482A and 482B and also the hopper door cylinder 476 and the hopper chute cylinder 480, all derive their high pressure fluid from pump 412. The circuit for the storage swing cylinders 482A and 482B includes the manually operated directional control valve 608 and the pilot-operated double check valve 616 which prevents the cylinders 482A and 482B from moving until required.

The carriage cylinder 125 and the boom cylinder 140 are components of the mucking unit 48. The carriage cylinder 125 is controlled by pilot operated directional control valve 454 which is piloted by solenoid actuated directional control valve 446. The circuit includes holding valve 462 which controls the rate of retraction of cylinder 125.

Boom cylinder 140 is controlled by pilot operated directional control valve 456 which is piloted by solenoid actuated directional control valve 448. The circuit includes holding valve 464 which controls the rate of extension of cylinder 140.

Solenoid actuated directional control valves 676, 678, 680, and 686 control the pumps 416 and 418 in conjunction with the pilot-operated pressure relief valves 658, 660, and 662. When pressure relief valves 658, 660, and 662 are piloted open, they provide a short bypass loop for the fluid from the pumps 416 and 418 so that the fluid goes directly back to tank 420. Specifically, when the solenoid valve 676 is in the neutral position, then relief valve 658 is piloted open and the fluid from pump 416 is unloaded at low pressure to tank 420 via lines 668 and 664. This avoids wasting energy when the fluid is not needed to perform any work. Moving solenoid valve 676 to the right connects the pilot line 670 to pressure relief valve 682 set at 1000 psi which is the pressure level that then controls relief valve 658. Moving solenoid valve 676 to the left connects the pilot line 670 to solenoid valve 686. When solenoid valve 686 is in the neutral position, the pilot fluid is blocked and relief valve 658 operates at its own setting of 2800 psig. When solenoid valve 686 is moved to the right, the pilot fluid goes to pressure relief valve 688 set at 750 psig which is the pressure level that then controls relief valve 658.

When the solenoid valve 678 is in the neutral position, then relief valve 660 is piloted open and the fluid from pump 418A is unloaded at low pressure to tank 420 via lines 666 and 664. Moving solenoid valve 678 to the right connects the pilot line 672 to pressure relief valve 684 set at 750 psig which is the pressure level that then controls relief valve 660. When solenoid valve 678 is moved to the left, the pilot fluid is blocked and relief valve 660 operates at its own setting of 1100 psig.

When solenoid valve 680 is in the neutral position, then relief valve 662 is piloted open and the fluid from pump 418B is unloaded at low pressure to tank 420 via lines 442, 420, 536, and heat exchanger 538. When solenoid valve is moved to the right, the pilot fluid is blocked and relief valve 662 operates at its own setting of 2500 psig.

The reason for inclusion of the pump output and pressure controls described above is to provide varying flow rates and maximum pressures to the mucking unit hydraulic actuators at different points in the operating cycle.

The carriage cylinder 125, the boom cylinder 140, the carriage swing cylinder 470, and the clam jaw cylinders 472A and 472B are all controlled by solenoid actuated directional control valves which are in turn controlled by limit switches according to the sequence of operation which is defined by the limit switches. When these cylinders reach the limit of their stroke, a limit switch is activated which in turn electrically controls the solenoid actuated valves.

The shaft boring machine 10 has an on-board gas detection system. A methane detector (not shown) continuously monitors the air in the vicinity of the face. If methane at the dilute concentration of 1% is detected, the cutterwheel 12 is stopped automatically. A second detector (not shown) is installed in the ventilation duct 54 at the top of the machine. If either monitor detects a 2% concentration, power is cut from all motor circuits. If necessary, additional detectors can be installed at potential gas pocket locations on the machine.

The method of operating the shaft boring machine 10 is next described. In general, the muck hoisting system determines the advance increment of the cutterwheel 12. The muck bucket 68 has a capacity of six cubic yards with a loaded weight of twelve tons. This size was chosen as a reasonable weight for hoisting and a size that could be accommodated on the machine 10.

Figure 5:
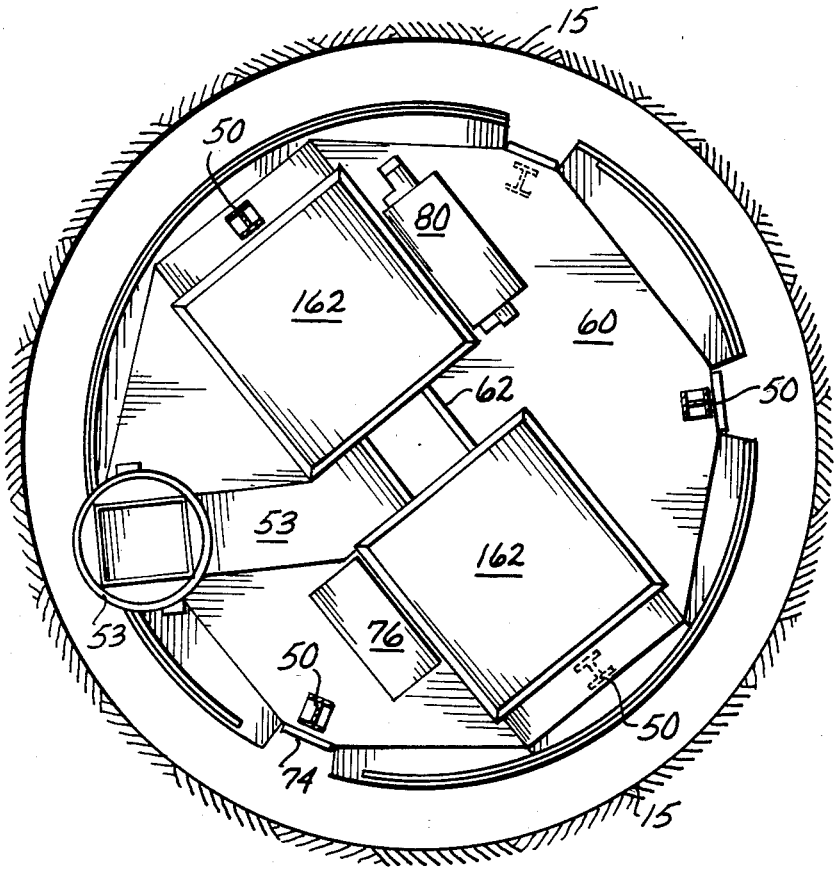
FIG. 5 is a top view of the typical embodiment of the present invention illustrated in FIG. 1, taken along line D—D thereof.

A single or a double drum hoisting system is used depending on the depth of the shaft. A double drum hoisting system is more efficient at greater depths. The hoist locations relative to the shaft, corresponding to the plan view in FIG. 5, are fixed. The shaft boring machine 10 is designed so that muck transfer from the storage hopper 24 to the hoist bucket 68 can occur only with the slewing base frame 110 in one specific position, in the case of a single drum hoisting system, or in two specific positions 180° apart, in the case of a double drum hoisting system. For maximum efficiency, the plunge taken by the cutterwheel 12 in one pass is selected so that upon completion of one slew revolution (360°) in the case of a single drum hoisting system or upon completion of either one-half slew revolution (180°) or one and one-half slew revolutions (540°) in the case of a double drum hoisting system, the amount of material cut fills the storage hopper 24 and is then transferred to fill the hoist bucket 68.

Turning now to the primary muck pickup system 48, the automated clam shell bucket 22 is the means of removal of the rock cuttings from the work face 13. The rock cuttings are pushed in toward the center of the shaft 15 by the plow 21 mounted on the guide column support 20A. The rock cuttings form the muck pile 23 which provides an efficient bite for the clam shell 22. As soon as the jaws are closed, the clam shell is lifted, in two stages, and then rotated so that it dumps the cuttings into the temporary storage hopper 24. The clam shell 22 then returns to pick up more material. The entire operation is controlled by a series of limit switches, although manual override is also provided. When the hopper 24 is full, the muck is then transferred to the hoist bucket 68 for removal by hoisting to the surface. The jaws of the clam shell 22 do not come into contact with the face, so that some material is inevitably left behind. This residual material is collected by the scraper blade 66 traveling behind the clam shell 22 and eventually piles up and is be picked up by the clam shell. The lowest position of the clam shell at any time is dependent on the depth of the cut as determined by the position of the cutterhead carriage 102.

At the start of a typical boring cycle, both the lower gripper system 34 and the upper gripper system 44 are extended against the shaft wall. The walking cylinders 40 are fully extended, the cutterwheel carriage 102 is fully raised, the machine 10 has been properly aligned and the muck hopper 24 is empty. At this point, the cutterwheel 12 is energized and the plunge cylinders 16A and 16B are extended the selected plunge distance, for example two inches. When the plunge is complete, the slew drive 106 and the mucking unit 48 are energized. The slew rate depends on the borability of the rock and is controlled by the operator. The operator increases or decreases the slew rate to maintain maximum power at the cutterwheel 12.

As explained above, the total slew angle accumulated by the time the hopper 24 is filled, depends on the type of hoist system. In the case of a single drum hoisting system, the hopper 24 will be full after one revolution. The cutterwheel 12 must be plunged upon completion of every slew revolution (360°), so that in the case of a double drum hoist, where a total of one and one-half slew revolutions (540°) may be necessary to fill the hopper 24, an intermediate plunge after one slew revolution (360°) is required.

When the required slew rotation angle has been accomplished and the hopper 24 has been filled, the full hopper 24 is lifted vertically to the elevated position shown in FIG. 8. This is accomplished by raising the hopper 24 on the hopper track 25 by extending the hopper lift cylinder 468 situated within the track 25. The mucking unit 48 is placed in the stored position as shown in FIG. 3 and then an empty bucket 68 is lowered down through one of the muck bucket openings 162 in the upper deck 60 and into the clam bucket well 78 normally occupied by the mucking unit 48. The hopper lip chute 96 is then extended by extending the hopper chute cylinder 480 as shown in FIG. 8. The hopper door 27 is then lifted vertically by retracting hopper door cylinder 476 and the muck slides down the lip chute 96 into the bucket 68. The full bucket 68 is hoisted to the surface. The hopper 24 is then returned to its loading position with the door 27 closed and the chute 96 retracted. This completes one mucking cycle. Whether a cutterwheel plunge is necessary prior to commencement of the next mucking cycle, or is not needed until after another one-half slew revolution (180°), again depends on the type of hoisting system.

When the two foot downward travel of the cutterwheel carriage 102 is complete, the grippers 34 and 44 must be advanced. The cutterwheel 12 is stopped and the cutterwheel carriage 102 is fully raised. The upper grippers 44 are then released and the walking cylinders 40 are retracted. As the upper gripper ring 46 moves down, it is centered with respect to the lower gripper ring 38 by centering collars 52. After the upper grippers 44 have been extended, the lower grippers 34 are released and the walking cylinders 40 extended. At this time, the machine 10 is realigned for the next two foot plunge increment. When the lower grippers 34 are fully extended, the boring cycle is complete.

Directional or steering corrections are made at the end of each boring cycle when the machine 10 is being supported by the upper grippers 44 and hanging from the walking cylinders 40. There are two types of steering corrections: (1) line of bore; and, (2) roll around the vertical axis. It is important that the machine 10 not rotate in the shaft as the hoist buckets 68 will become out of alignment. Four position references are employed, two laser beams parallel to the shaft axis 64 and two inclinometers mounted at right angles. Three position checks are performed. The machine 10 is leveled by retracting the appropriate pairs of walking cylinders 40 using the inclinometers as reference. Roll position about the shaft axis is established by extending or retracting the two roll correction cylinders 42A and 42B, which may be independently controlled (by having two separate valves like valve 342) if desired, while using the two laser beams and the two machine mounted targets 32 as reference. Radial position of the cutterwheel 12 is established by extending the appropriate gripper shoes using the laser beams and targets as reference. In hard rock, it may be necessary to have the cutterwheel 12 rotating when radial corrections are made.

Figure 11:
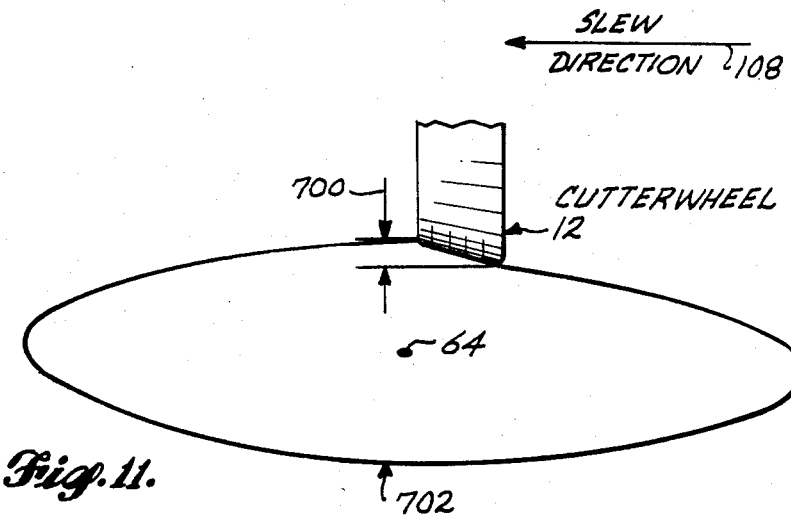
FIG. 11 is a schematic representation of an alternative spiral cutting mode of operation of the shaft boring machine.

FIG. 11 is a schematic representation of an alternative spiral or helical cutting mode of operation wherein the cutterwheel assembly 12 progressively plunges downwardly into the work face 13. This provides an alternate cutting action in which, instead of making a level slew cut after a discrete plunge, slewing and plunging occur simultaneously to produce a continuous or substantially continuous helix 702. The advantage of this helical cutting mode is that there is no large step which the plow 21, the muck removal system 48, and the scraper blade 66 must negotiate after about one-half of a slew revolution. The distance from the work face 13 to the clam shell 22 is substantially constant, avoiding the problem of either having to adjust the clam shell height or of being forced to leave a significant volume of cut material on the work face.

It is desired in the spiral cutting mode that the plunge per slew revolution be equal to the normal plunge depth 700. If the plunge is any greater, efficient cutting is not possible. The means of accomplishing this desired result is, for example, either by (a) electrically or hydraulically controlling the fluid flow rate into the plunge cylinders 16A and 16B according to the slewing rate or by (b) a positional feedback system based on the accumulated angle of slew. This second mode of control can be effected continuously or incrementally (step-wise).

Alternatively, the desired plunge rate in the spiral cutting mode can be achieved by use of a sensing probe or wheel which leads the cutterwheel in the direction of slewing and continuously senses and then dynamically controls through hydraulic valving (or the like) the depth of cut of the continuously plunging cutterwheel.

Inspection and changing of the disc cutters 84 takes place from the clam bucket well 78 through an opening in the cutterwheel shroud. Cutterwheel positioning is accomplished using the inching drive motor 485, which can be declutched in normal operation.

A key switch (not shown) is provided to lock out the cutterwheel control circuit when someone is actually working on the cutterwheel. It is the responsibility of the worker to use the key switch. A folding platform is provided as a work base, and a small hoist is conveniently located for handling the cutters. In adverse ground conditions, it is possible to install rock bolts approximately six feet from the bottom of the shaft. A rock drill can be mounted from the lower part of the slewing base frame 110 in the clam bucket well 78. The slew rotate drive 106 is used to position the drill around the circumference of the shaft.

A dewatering pump (not shown) can be installed next to the clam bucket well 78 with a suction line located behind the muck scraper 66. Such a pump discharges into the stationary water ring 36 (FIG. 1) located above the lower gripper ring 38. A transfer pump (also not shown) located adjacent to the water ring 36 transfers the water from the water ring 36 to the shaft discharge lines. This arrangement allows continuous dewatering as the machine 10 is boring.

The diameter range of the shaft boring machine 10 is about twenty to twenty-four feet. The change increments are one foot on the diameter. The items affected by a diameter change are: (a) the position, speed, and diameter of the cutterwheel 12; (b) the length of the lower support beams 20 for the cutterwheel guide columns 18; (c) the contour of the muck scraper 66; (d) the diameter of the dust shield 30; and, (e) the position and curvature of the gripper shoes 142 and 152.

Repositioning the cutterwheel 12 is accomplished by moving the guide columns 18 to pre-established mounting locations in the slewing base frame 110 and the installation of two new lower support beams 20. Two new outer segments for the cutterwheel body 88 are required, including the cutter pedestals 86 to change the diameter of the wheel. Whether a speed change is required depends on the change increment and the type of rock. If a speed change is required, the gearing in the first stage of the two planetary speed reducers 100 will need appropriate replacement.

The contour of the muck scraper 66 can be changed by replacing the scraping edge. A new dust shield 30 is required for each diameter. The curvature of the change of the gripper shoes 142 and 152 can be accommodated by welding on appropriate plates to the bearing surfaces. The new radial position of the grippers can be provided by the installation of new cylinder and guide support elements. As the diameter of the machine increases from the minimum of twenty feet, the number of plunge cycles per boring cycle increases and the machine advance rate decreases.

The above-described embodiments are intended to be illustrative, not restrictive. The full scope of the invention is defined by the claims, and any and all equivalents are intended to be embraced.

What is claimed is:

1. The method of boring a large diameter, blind hole vertical shaft, comprising the steps of:

(a) arranging a cutterwheel carrying multiple peripherally mounted rolling cutter units radially of the shaft for rotation in a vertical plane; and (b) rotating the cutterwheel about a horizontal axis while slewing the cutterwheel about the center axis of the shaft and across the bore work face.

2. The method of claim 1, wherein the cutterwheel is of bevelled cross-sectional configuration, with a slightly increasing diameter in the trailing portion thereof.

3. The method of claim 2, further comprising the step of:

(c) removing cut material from the bore work face by excavator means following the cutterwheel.

4. A method of boring vertical shafts in medium and hard rock, comprising the steps of:

(a) providing a cutterwheel assembly means for cutting said rock, said cutterwheel assembly means having a substantially horizontal axis of rotation and having multiple peripherally mounted rolling cutter units, each rotatable about its own axis;

(b) while rotating said cutterwheel assembly means about its own substantially horizontal axis, plunging said rotating cutterwheel assembly means downwardly a selected depth into the rock work face;

(c) while rotating said cutterwheel assembly means about its substantially horizontal axis, slewing said rotating cutterwheel assembly means around said rock work face about a vertical axis, the rolling cutter units on said cutterwheel assembly means being rotated about their respective axes by contact with the work face in the course of slewing around the work face;

(d) removing the rock cuttings from the work face to a hopper means while slewing said rotating cutterwheel assembly means around the work face;

(e) stopping said slewing movement of said cutterwheel assembly means at a point which is 360° from the starting point; and (f) repeating steps (b), (c), (d), and (e) above.

5. The method of claim 4, wherein said rotating cutterwheel assembly means is plunged downwardly into said rock work face in step (b) until the plunge depth is about 2 to 4 inches.

6. The method of claim 4, wherein the diameter of the vertical shaft is about 20 to 24 feet.

7. The method of claim 4, wherein each rolling cutter unit on said cutterwheel assemby means is a disc cutter having a diameter of about 10 to 18 inches.

8. A method of boring vertical shafts in medium and hard rock, comprising the steps of:

(a) providing a cutterwheel assembly means for cutting said rock, said cutterwheel assembly means having a substantially horizontal axis of rotation and having multiple peripheraly mounted rolling cutter units, each rotatable about its own axis;

(b) while rotating said cutterwheel assembly means about its own substantially horizontal axis, plunging said rotating cutterwheel assembly means downwardly a selected depth into the rock work face;

(c) while rotating said cutterwheel assembly means about its substantially horizontal axis, slewing said rotating cutterwheel assembly means around said rock work face about a vertical axis, the rolling cutter units on said cutterwheel assembly means being rotated about their respective axes by contact with the work face in the course of slewing around the work face;

(d) removing the rock cuttings from the work face to a hopper means while slewing said rotating cutterwheel assembly means around the work face;

(e) stopping said slewing movement of said cutterwheel assembly means at a point which is 180°, 360°, or 540° from the starting point;

(f) transferring the rock cuttings from said hopper means to a bucket means and hoisting said bucket means vertically away from said hopper means; and (g) repeating steps (c), (d), (e), and (f) above.

9. The method of claim 8, wherein said rotating cutterwheel assembly means is plunged downwardly into said rock work face in step (b) until the plunge depth is about 2 to 4 inches.

10. The method of claim 8, wherein the diameter of the vertical shaft is about 20 to 24 feet.

11. The method of claim 8, wherein each rolling cutter unit on said cutterwheel assembly means is a disc cutter having a diameter of about 10 to 18 inches.

12. The method of boring vertical shafts in medium and hard rock, comprising the steps of:

(a) providing a cutterwheel assembly means for cutting said rock, said cutterwheel assembly means having a substantially horizontal axis of rotation and having multiple peripherally mounted rolling cutter units, each rotatable about its own axis;

(b) while rotating said cutterwheel assembly means about its own substantially horizontal axis, plunging said cutterwheel assembly means downwardly a selected depth into the rock work face;

(c) while rotating said cutterwheel assembly means about its substantially horizontal axis, slewing said rotating cutterwheel assembly means around said rock work face about a vertical axis, the rolling cutter units on said cutterwheel assembly means being rotated about their respective axes by contact with the work face in the course of slewing around the work face;

(d) removing the rock cuttings from the work face to a hopper means while slewing said rotating cutterwheel assembly means around the work face;

(e) stopping said slewing movement of said cutterwheel assembly means at a point which is 180°, 360°, or 540° from the starting point;

(f) transferring the rock cuttings from said hopper means to a bucket means and hoisting said bucket means vertically away from said hopper means;

(g) resuming said slewing movement of said rotating cutterwheel assembly means and removing the rock cuttings from the work face to said hopper means while slewing said rotating cutterwheel assembly means around the work face;

(h) stopping said slewing movement of said cutterwheel assembly means at a point which is 180°, 360°, or 540° from the previous stopping point; and (i) transferring the rock cuttings from said hopper means to a bucket means and hoisting said bucket means vertically away from said hopper means.

13. The method bf claim 12, wherein said rotating cutterwheel assembly is plunged downwardly into said rock work face in step (b) until the plunge depth is about 2 to 4 inches.

14. The method of claim 12, wherein the diameter of the vertical shaft is about 20 to 24 feet.

15. The method of claim 12, wherein each roller cutter unit on said cutterwheel assembly means is a disc cutter having a diameter of 10 to 18 inches.

16. A shaft boring machine for cutting a vertical shaft in medium and hard rock, comprising:

(a) a cutterwheel assembly means for slewing about the center axis of the shaft while cutting the rock work face, said cutterwheel assembly means having a substantially horizontal axis of rotation and having multiple peripherally mounted rolling cutter units;

(b) rotation means for rotating said cutterwheel assembly means about its horizontal axis;

(c) cutterwheel support means for supporting said cutterwheel assembly means, said cutterwheel support means allowing movement of said cutterwheel assembly means in a vertical plane;

(d) rotatable base frame means for supporting said cutterwheel support means;

(e) plunge means for lowering and raising said cutterwheel assembly meaňs, said plunge means being mounted on said cutterwheel support means and said base frame means;

(f) muck removal means for removing rock cuttings from the face of said shaft, said muck removal means being supported by said base frame means and operated independently of said cutterwheel assembly means;

(g) first gripper ring means for stabilizing said machine in said shaft, said first gripper ring means being substantially horizontal and having support means for supporting said base frame means and gripper means for holding said first gripper ring means stationary in said shaft;

(h) said base frame means including support means for rotatably supporting said base frame means from said first gripper ring means, said base frame means further including drive means for slewing said base frame means in a substantially horizontal plane about the vertical axis of said machine;

(i) second gripper ring means for stabilizing said machine in said shaft, said second gripper ring means being substantially horizontal and being located above said first gripper ring means, said second gripper ring means having gripper means for holding said second gripper ring means stationary in said shaft; and (j) walking means for lowering and raising said first and second gripper ring means, said walking means being mounted on said first and second gripper ring means.

17. The shaft boring machine of claim 16, wherein said rolling cutter units on said cutterwheel assembly means are disc cutters about 10 to 18 inches in diameter.

18. The shaft boring machine of claim 16, wherein said rotation means for rotating said cutterwheel assembly means comprises plural electric motors.

19. The shaft boring machine of claim 16, wherein said cutterwheel support means for supporting said cutterwheel assembly means comprises a cutterwheel carriage means slidably supported on two vertical guide column means, said guide column means being mounted on said base frame means.

20. The shaft boring machine of claim 19, wherein said plunge means for lowering and raising said cutterwheel assembly means comprises plural hydraulic cylinder means mounted on said base frame means and said cutterwheel carriage means.

21. The shaft boring machine of claim 16, wherein said muck removal means for removing rock cuttings from the face of said shaft comprises excavator means mounted on an extendable boom means supported by a boom carriage means which is supported by said base frame means.

22. The shaft boring machine of claim 21, wherein said muck removal means further comprises hopper means for receiving said rock cuttings from said clam shell bucket means, said hopper means being supported by said base frame means.

23. The shaft boring machine of claim 22, wherein said muck removal means further comprises muck bucket means for receiving said rock cuttings from said hopper means, said muck bucket means being transportable vertically in said shaft.

24. The shaft boring machine of claim 16, wherein said first gripper ring means includes track means for supporting said base frame means and hydraulic cylinder means for holding said first gripper ring means stationary in said shaft.

25. The shaft boring machine of claim 24, wherein said base frame means includes support roller means contacting said track means to rotatably support said base frame means.

26. The shaft boring machine of claim 16, wherein said drive means for slewing said base frame means in a substantially horizontal plane comprises multiple hydraulic motor means mounted on said base frame means, said hydraulic motor means driving against gear means mounted on said first gripper ring means.

27. The shaft boring machine of claim 16, wherein said second gripper ring means includes hydraulic cylinder means for holding said second gripper ring means stationary in said shaft.

28. The shaft boring machine of claim 16, wherein said walking means for lowering and raising said first and second gripper ring means comprises hydraulic cylinder means mounted on said first and second gripper ring means.

29. A method of boring vertical shafts in medium and hard rock, comprising the steps of:

(a) providing a cutterwheel assembly means for cutting said rock, said cutterwheel assembly means having a substantially horizontal axis of rotation and having multiple peripherally mounted rolling cutter units, each rotatable about its own axis, sid rolling cutter units collectively having a cutting profile, when slewing, in the form of a ramp;

(b) while rotating said cutterwheel assembly means about its own substantially horizontal axis, progressively plunging said rotating cutterwheel assembly means downwardly into the rock work face;

(c) while rotating said cutterwheel assembly means about its substantially horizontal axis, slewing said rotating cutterwheel assembly means around said rock work face about a vertical axis, the rolling cutter units on said cutterwheel assembly means being rotated about their respective axes by contact with the work face in the course of slewing around the work face; and (d) removing the rock cuttings from the work face while slewing said rotating cutterwheel assembly means around the work face.

30. The method of claim 29, wherein the diameter of the vertical shaft is about twenty to twenty-four feet.

31. The method of claim 29, wherein said rotating cutterwheel assembly means is plunged downwardly into the rock work face in a step-wise mode.

32. The method of claim 29, wherein said rotating cutterwheel assembly means is plunged downwardly into the rock work face in a continuous mode.

33. The method of claim 29, wherein each rolling cutter unit on said cutterwheel assembly means is a disc cutter having a diameter of about ten to eighteen inches.

34. A method of boring vertical shafts in medium and hard rock, comprising the steps of:

(a) providing a cutterwheel assembly means for cutting said rock, said cutterwheel assembly means having a substantially horizontal axis of rotation and having multiple peripherally mounted rolling cutter units, each rotatable about its own axis, said rolling cutter units collectively having a cutting profile, when slewing, in the form of a ramp;

(b) while rotating said cutterwheel assembly means about its own substantially horizontal axis, continuously plunging said rotating cutterwheel assembly means downwardly into the rock work face;

(c) while rotating said cutterwheel assembly means about its substantially horizontal axis, slewing said rotating cutterwheel assembly means around said rock face about a vertical axis, the rolling cutter units on said cutterhead assembly means being rotated about their respective axes by contact with the work face in the course of slewing around the work face;

(d) removing the rock cuttings from the work face to a hopper means while slewing said rotating cutterwheel assembly means around the work face;

(e) stopping said slewing movement of said cutterwheel assembly means at a point which is 180°, 360°, or 540° from the starting point;

(f) transferring the rock cuttings from said hopper means to a bucket means and hoisting said bucket means vertically away from said hopper means; and (g) repeating steps (b), (c), (d), (e), and (f) above.

35. The method of claim 34, wherein the diameter of the vertical shaft is about twenty to twenty-four feet.

36. The method of claim 34, wherein each rolling cutter unit on said cutterwheel assembly means is a disc cutter having a diameter of about ten to eighteen inches.

* * * * *